US012157862B2

(12) United States Patent
De Klerk et al.

(10) Patent No.: US 12,157,862 B2
(45) Date of Patent: Dec. 3, 2024

(54) METHODS FOR PRODUCING JET FUEL FROM ALCOHOLS AND MIXTURES CONTAINING ALCOHOLS

(71) Applicant: Greenfield Global Inc., Toronto (CA)

(72) Inventors: Arno De Klerk, Edmonton (CA); Cibele Melo Halmenschlager, Edmonton (CA); Felix Rudolf August Link, Halle (DE)

(73) Assignee: Greenfield Global Inc., Toronto (CA)

( * ) Notice: Subject to any disclaimer, the term of this patent is extended or adjusted under 35 U.S.C. 154(b) by 0 days.

(21) Appl. No.: 18/417,926

(22) Filed: Jan. 19, 2024

(65) Prior Publication Data

US 2024/0247200 A1 Jul. 25, 2024

Related U.S. Application Data

(60) Provisional application No. 63/440,224, filed on Jan. 20, 2023.

(51) Int. Cl.
*C10G 69/12* (2006.01)

(52) U.S. Cl.
CPC ... *C10G 69/126* (2013.01); *C10G 2300/1088* (2013.01); *C10G 2300/1096* (2013.01); *C10G 2400/08* (2013.01)

(58) Field of Classification Search
CPC ..... C10G 69/126; C10G 2300/1088; C10G 2300/1096; C10G 2400/08
See application file for complete search history.

(56) References Cited

U.S. PATENT DOCUMENTS

| | | | | |
|---|---|---|---|---|
| 3,894,107 | A | 7/1975 | Butter et al. | |
| 8,378,160 | B2 | 2/2013 | Gruber et al. | |
| 8,546,627 | B2 | 10/2013 | Gruber et al. | |
| 10,011,789 | B2 | 7/2018 | De Klerk | |
| 11,078,433 | B2 | 8/2021 | Smith et al. | |
| 2016/0194257 | A1* | 7/2016 | Lilga | B01J 29/7007 585/517 |

(Continued)

FOREIGN PATENT DOCUMENTS

| | | | |
|---|---|---|---|
| WO | 2016/067032 | A1 | 5/2016 |
| WO | 2020/154810 | A1 | 8/2020 |

OTHER PUBLICATIONS

Xu, S., et al. Advances in catalysis for methanol-to-olefins conversion. Adv. Catal. 2017, 61, 37-122.

(Continued)

*Primary Examiner* — Brian A Mccaig
(74) *Attorney, Agent, or Firm* — McCarthy Tétrault LLP

(57) ABSTRACT

An alcohol-containing feed is transformed by the use of only two distinct conversion process steps into products, of which one product is a kerosene that is a fully formulated aviation turbine fuel (jet fuel) comprising of mostly n-alkanes, isoalkanes, cycloalkanes, and aromatics. The first conversion step is acid-catalyzed conversion and the second conversion step is hydrotreating. The kerosene product is within the compositional limits for aviation turbine fuel containing synthesized material and it requires no blending to be fully formulated. Specifically the product contains sufficient aromatics to be within the prescribed range of aromatics (8-26.5 vol % or or 8-25 vol %.) for aviation turbine fuel containing synthesized material.

19 Claims, 2 Drawing Sheets

(56) References Cited

U.S. PATENT DOCUMENTS

| | | | | |
|---|---|---|---|---|
| 2016/0194572 | A1 | 7/2016 | Lilga et al. | |
| 2017/0355649 | A1* | 12/2017 | Narula | C07C 1/20 |
| 2018/0201554 | A1 | 7/2018 | Greene et al. | |

OTHER PUBLICATIONS

Chang, C. D. Hydrocarbons from methanol. Catal. Rev. Sci. Eng. 1983, 25, 1-118.
Keil, F. J. Methanol-to-hydrocarbons: Process technology. Microporous Mesoporous Mater. 1999, 29, 49-66.
Pease, R. N.; Yung, C. C. The catalytic dehydration of ethyl alcohol and ether by alumina. J. Am. Chem. Soc. 1924, 46, 390-403.
Bi, J., et al. High effective dehydration of bio-ethanol into ethylene over nanoscale HZSM-5 zeolite catalysts. Catal. Today 2010, 149, 143-147.
Adkins, H.; Perkins, P. P. Dehydration of alcohols over alumina. J. Am. Chem. Soc. 1925, 47, 1163-1167.
Nel, R. J. J.; De Klerk, A. Dehydration of C5-C12 linear 1-alcohols over eta-alumina to fuel ethers. Ind. Eng. Chem. Res. 2009, 48, 5230-5238.
Whitmore, F. C. Mechanism of the polymerization of olefins by acid catalysts. Ind. Eng. Chem. 1934, 26, 94-95.
Nicholas, C. P. Applications of light olefin oligomerization to the production of fuels and chemicals. Appl. Catal. A 2017, 543, 82-97.
Chauvin, Y., et al. Upgrading of C2, C3, C4 olefins by IFP Dimersol technology. Erdöl, Erdgas, Kohle 1990, 106 (7/8), 309-315.
Brooks, K. P. et al Low-Carbon Aviation Fuel Through the Alcohol to Jet Pathway. In Biofuels for Aviation: Feedstocks, Technology and Implementation; Chuck, C. J. Ed.; Academic Press: Amsterdam, 2016, 109-150.
Chang, C. D., et al. The conversion of methanol and other O-compounds to hydrocarbons over zeolite catalysts. II. Pressure effects. J. Catal. 1979, 56, 169-173.
ASTM International. Astm D7566-21, Standard specification for aviation turbine fuel containing synthesized hydrocarbons; ASTM International: West Conshohocken, PA, 2021.
Garwood, W. E. Conversion of C2-C10 to higher olefins over synthetic zeolite ZSM-5. ACS Symp. Ser. 1983, 218, 383-396.
Ramasamy, K. K.; Wang, Y. Ethanol conversion to hydrocarbons on HZSM-5: Effect of reaction conditions and Si/Al ratio on the product distributions. Catal. Today 2014, 237, 89-99.
Chen, N. Y.; Yan, T. Y. M2 Forming—A process for aromatization of light hydrocarbons. Ind. Eng. Chem. Proc. Des. Dev. 1986, 25, 151-155.
Nash, C. P., et al. Mixed alcohol dehydration over Brønsted and Lewis acidic catalysts. Appl. Catal. A 2016, 510, 110-124.
Tau, L. M., et al. Methanol to gasoline: Carbon-14 tracer studies of the conversion of methanol/higher alcohol mixtures over ZSM-5. Fuel Process. Technol. 1990, 26, 209-219.
Köhler, E., et al. Converting olefins to diesel—the COD process. Hydrocarbon Technol. Int. 1995, Summer, 37-40.
Fuhse, J.; Bandermann, F. Conversion of organic oxygen compounds and their mixtures on H-ZSM-5. Chem. Eng. Technol. 1987, 10, 323-329.
Geleynse, S., et al. The Alcohol-to-Jet Conversion Pathway for Drop-In Biofuels: Techno-Economic Evaluation. Wiley-VCH. 2018 (edition: author manuscript).
ASTM International. ASTM D7566-23b, Standard specification for aviation turbine fuel containing synthesized hydrocarbons; ASTM International: West Conshohocken, PA, Nov. 2023.
Kennedy, J. P. Cationic polymerization of olefins: A critical inventory; Wiley: New York, 1975, p. 56-57.
Washecheck, P. H. Manufacture of higher straight-chain alcohols by the ethylene chain growth process. ACS Symp. Ser. 1981, 159, 87-100.
Liler, M. Reaction mechanisms in sulfuric acid and other strong acid solutions; Academic Press: London, 1971, p. 300-301.
Ipatieff, V. N. Catalytic reactions at high pressures and temperatures; The Macmillan Company: New York, 1936, p. 599-602, 607-617.
Ipatieff, V. N.; Pines, H. Conjunct polymerization—the influence of temperature, concentration, and quantity of sulfuric acid on polymerization of olefins. J. Org. Chem. 1936, 1, 464-489.
De Klerk, A. Key catalyst types for the efficient refining of Fischer-Tropsch syncrude: alumina and phosphoric acid. In Catalysis vol. 23; Spivey, J. J., Dooley, K. M. Eds.; Royal Society of Chemistry: Cambridge, UK, 2011, p. 1-49.
York, D., et al. UOP catalytic condensation process for transportation fuels. In Handbook of petroleum refining processes, 2ed; Meyers, R. A. Ed.; McGraw-Hill: New York, 1996, p. 1.21-1.29.
Ipatieff, V. N.; Pines, H. Polymerization of ethylene under high pressures in the presence of phosphoric acid. Ind. Eng. Chem. 1935, 27, 1364-1369.
Ipatieff, V. N.; Corson, B. B. Gasoline from ethylene by catalytic polymerization. Ind. Eng. Chem. 1936, 28, 860-863.
De Klerk, A., et al. Oligomerization of Fischer-Tropsch olefins: Effect of feed and operating conditions on hydrogenated motor-gasoline quality. Ind. Eng. Chem. Res. 2004, 43, 7449-7455.
De Klerk, A. Properties of synthetic fuels from H-ZSM-5 oligomerization of Fischer-Tropsch type feed material. Energy Fuels 2007, 21, 3084-3089.
Prinsloo, N. M. Solid phosphoric acid oligomerisation: Manipulating diesel selectivity by controlling catalyst hydration. Fuel Process. Technol. 2006, 87, 437-442.
International Search Report and Written Opinion dated Apr. 26, 2024 issued in the corresponding International Application No. PCT/CA2024/050064.

* cited by examiner

METHODS FOR PRODUCING JET FUEL FROM ALCOHOLS AND MIXTURES CONTAINING ALCOHOLS

CROSS-REFERENCE TO RELATED APPLICATION

This application claims the benefit of U.S. Provisional Application No. 63/440,224, filed Jan. 20, 2023, the entire contents of which are hereby incorporated by reference herein.

TECHNICAL FIELD

The present disclosure relates to processes and systems for producing kerosene from alcohols and mixtures containing alcohols. Kerosene produced by a process of the present disclosure can be a fully-formulated aviation turbine fuel (jet fuel) or a component thereof, which comprises mostly n-alkanes, isoalkanes, cycloalkanes, and aromatics.

BACKGROUND

Alcohol-to-jet synthetic paraffinic kerosene (ATJ-SPK) is one of biofuel technologies approved by the American Society for Testing and Materials (ASTM) D7566. Alcohol-to-jet synthetic paraffinic kerosene with aromatics (ATJ-SKA) is another one of biofuels technologies recently approved by ASTM D7566 [28]. The ATJ process produces jet fuel from biomass-derived alcohols. The key notion of the process is to utilize alcohols abundantly available from renewable resources for production of hydrocarbon fuels required for jet turbines. Initially, ASTM D7566 only permitted isobutanol as feedstock for ATJ-SPK but was amended in 2018 to include ethanol as well. ATJ-SPK is produced by way of three separate catalytic reactions, which are dehydration, oligomerization, and hydrogenation that are arranged in series, followed by fractionation [26].

The kerosene product of the ATJ-SPK process comprises of a mixture of n-alkanes, isoalkanes, and cycloalkanes but lacks aromatic content, only with less than 8 vol % aromatics, and more specifically, less than 0.5 mass % aromatics. The ATJ-SPK product requires blending with other materials (e.g., petro-jet fuel) at up to 50% and therefore, it is not a fully-formulated jet fuel. The kerosene product of the ATJ-SKA process comprises of a mixture of n-alkanes, isoalkanes, cycloalkanes, and aromatics. While its aromatics content is 8 to 20 vol % and therefore it is fully formulated, the kerosene product is composed of the streams of two sub-processes: a non-aromatic product stream comprising dehydration, oligomerization, and hydrogenation, and an aromatic product stream comprising dehydration, aromatization, and hydrogenation [28].

In a jet engine, a minimum amount of aromatics are necessary in order to ensure the proper swelling of the elastomeric seals in the fuel systems and prevent leakage, which can be a fire safety hazard. ASTM D1655 allows for an aromatic content of <25% but requires a minimal level of aromatic content 8% to be present in the fuel.

The blending of ATJ-SPK with aromatics that were produced from alcohols has been suggested to be analogous to the blending with petroleum-derived kerosene as source of aromatics to obtain fully-formulated jet fuel. The type of operations and techniques used in petroleum refining to blend different materials to achieve a composition that would meet fuel specifications, can equally applied to alcohol-derived materials, including ATJ-SPK, to produce fully-formulated jet fuel. For example, Lilga, et al. in "Systems and processes for conversion of ethylene feedstocks to hydrocarbon fuels" explained how ethanol can be converted to ethene and heavier hydrocarbons and blended to produce fuels with a wide range of compositions, which includes kerosene blending to produce jet fuel [20].

Another approach to produce fully-formulated synthetic jet fuel is employing alkenes as feed material. Starting with an alkene feed, oligomerization can be employed to produce a kerosene product that is fully formulated, for example, as taught by De Klerk, et al. in "A process for producing synthetic jet fuel" [19]. A third approach is producing aliphatic and aromatic hydrocarbons separately using biomass-derived alcohols and combining the two types of hydrocarbons in accordance with the requirements for fully-formulated jet fuel [27]. The blending of two products, of which one contains aromatics, is also the method described in ASTM D7566 to produce ATJ-SKA.

Separate production of aromatics from alcohols and separate production of aromatics from alkenes that were obtained by alcohol dehydration, are both processes that are possible. Alcohols can be dehydrated first and aromatics can then be produced from the alkenes that were obtained from alcohol dehydration. These steps may be conducted independently or may be combined by co-feeding oxygen-containing compounds (oxygenates) with hydrocarbons as illustrated in the refinery designs described by De Klerk in "Fischer-Tropsch jet fuel process" [17]. Processes such as alcohol-aromatic alkylation, or alkene-aromatic alkylation can be employed to increase the amount of kerosene boiling range aromatics.

In summary, the prior art shows that there are two main outcomes for producing kerosene-range hydrocarbons from alcohols. One outcome is where alcohols are dehydrated first and then an appropriate olefin oligomerization technology is employed to obtain kerosene comprising mainly of non-aromatic hydrocarbons. Another outcome is where alcohols are directly converted into hydrocarbons to obtain kerosene comprising of mainly aromatic hydrocarbons. However, currently there is no viable process using alcohol feedstock to directly produce fully-formulated jet fuel with sufficient aromatic content.

Therefore, there is a need for an improved process that is capable of producing fully-formulated jet fuel from alcohol feedstock in an efficient manner.

SUMMARY OF THE DISCLOSURE

This disclosure relates to processes and systems for producing an aviation turbine fuel comprising mostly of n-alkanes, isoalkanes, cycloalkanes, and aromatics, from alcohols and mixtures containing alcohols. The fuel can be a fully-formulated aviation turbine fuel (jet fuel) that does not require blending with other fuels.

Materials that can be employed as feed material for the process of the present disclosure are purified alcohols, mixtures of alcohols, or mixtures of one or more alcohols in combination with any or all of water, hydrocarbons, and other oxygen-containing compounds. The apparatus and method can comprise of two conversion process steps, each followed by appropriate separation, after which a fully-formulated aviation turbine fuel can be obtained as a product.

The first step in the process can involve contacting the feed material with an acid catalyst at appropriate conditions to convert the feed material into a product comprising hydrocarbons, water, and oxygen-containing compounds. In a preferred embodiment, the acid catalyst is a zeolite catalyst with the MFI zeolite framework type (e.g., H-ZSM-5). The combinations of temperature, pressure, flow rate/space velocity, and recycle-to-feed ratio can lead to the desired outcome.

Surprisingly, the inventors have discovered that hydrogen transfer from alcohols to alkenes to produce carbonyls and alkanes is an important catalytic pathway to regulate production of aromatics, through the conversion of carbonyls to aromatics. The combination of operating conditions can be used to regulate alcohol to carbonyl conversion and carbonyl to aromatic conversion to control aromatics content in kerosene to enable alcohol conversion to fully-formulated synthetic jet fuel.

The first step of the process can be performed in a way that the product from the first step has a kerosene boiling range fraction that contains a mixture that comprises of 5-35 wt % aromatics. More specifically, the first step can produce a product that has a kerosene boiling range fraction that is a hydrocarbon product with 8-26.5 or 8-25 vol % aromatics. The yield of the kerosene boiling range fraction can be at least 40 wt % of the hydrocarbon product from the first step in the process that is a liquid hydrocarbon product at standard conditions of 25° C. and 101.325 kPa (1 atm). In some embodiments, the kerosene boiling range fraction is at least 50 wt % of the hydrocarbon product from the first step of the process and that is a liquid hydrocarbon product at standard conditions.

The total product from the first step in the process can be separated into different fractions using techniques known in the art. In a preferred embodiment, the total product from the first step in the process is separated into five fractions. The five fractions from the first step in the process can be: (i) a gaseous product comprising mainly of light hydrocarbons, (ii) an aqueous liquid product comprising mainly of water and oxygen-containing species dissolved in the water, (iii) a first organic liquid product that comprises of material with an atmospheric-equivalent boiling point lower than the kerosene boiling range, (iv) a second organic liquid product that includes the material in the kerosene and heavier boiling range, and (v) optionally a third organic liquid product separated from material in the kerosene and higher boiling range. The choice of separation is not considered limiting to the process and can be selected in a way to best match the product from the first step in the process.

The gaseous product from the first step in the process comprises mainly of light hydrocarbons, which include alkenes. In a preferred embodiment, the gaseous product from the first step is recycled to form part of the feed material to the first step of the process. The recycling can be achieved by means that are known to those skilled in the art.

The aqueous liquid product from the first step in the process comprises mainly of water, with dissolved oxygen-containing compounds. The dissolved oxygen-containing compounds may include, but without limitation, alcohols, ethers, and carbonyl-containing compounds. In a preferred embodiment, part of the aqueous liquid product from the first step is recycled to form part of the feed material to the first step of the process. The recycling can be achieved by means that are known to those skilled in the art and may include further separation of the aqueous liquid product before recycling.

The first organic liquid product from the first step in the process comprises mainly of hydrocarbons together with some oxygen-containing compounds with an atmospheric-equivalent boiling point lower than the kerosene boiling range. The hydrocarbons include, but without limitation, alkenes, alkanes, and aromatics. In a preferred embodiment, part of the first organic liquid product from the first step is recycled to form part of the feed material to the first step of the process. The recycling can be achieved by means that are known to those skilled in the art and may include further separation of the first organic liquid product before recycling a fraction of the first organic liquid product. The part of the first organic liquid product that is not recycled to the first step of the process is called the first naphtha product from the process. In some embodiments, the first naphtha product from the process may be used as feed material for the second step in the process.

The second organic liquid product from the first step in the process comprises mainly of hydrocarbons and includes the material in the kerosene boiling range. The hydrocarbons include, but without limitation, alkenes, alkanes, and aromatics. The second organic liquid product from the first step in the process becomes the feed material for the second step in the process.

The third organic liquid product from the first step in the process comprises part of the hydrocarbons in the kerosene and heavier boiling range, which is separated to remove material that may be detrimental to the final products obtained after the second step of the process. In particular, but without limitation, durene and n-alkane species that may be present in the kerosene and heavier boiling range may optionally be removed to comprise the third organic liquid product when such species are present at sufficiently high concentration to merit removal. The third organic liquid product may be recovered as a final product, or this material may be further processed using methods known in the art, such as hydroisomerization and transalkylation, to change its properties to make it suitable as feed material to the second step of the process. Those that are skilled in the art can employ other treatments useful for upgrading the third organic liquid.

The feed to the second step of the process is either the second organic liquid product from the first step in the process, or a mixture comprising of a fraction of the first organic liquid product from the first step in the process and the second organic liquid product from the first step in the process.

The second step in the process involves contacting the feed to the second step with added hydrogen ($H_2$) over a hydrotreating catalyst to convert the feed to a product with increased hydrogen content. The intent of this second step of the process is to substantially convert alkenes to alkanes, without substantially converting aromatics to cycloalkanes. The purpose of the hydrotreating is to convert the alkenes to sufficient extent to meet the thermal oxidative stability requirement for aviation turbine fuel. To achieve this objective, some aromatics may also be converted to cycloalkanes, although this is not the specific intent. Hydrotreating to achieve the stated objectives is already known in the art. In a preferred embodiment, hydrotreating in the second step of the process is performed using a reduced base metal catalyst, for example, reduced nickel on alumina support ($Ni/Al_2O_3$).

The total product from the second step in the process can be separated into different fractions using techniques known in the art. In a preferred embodiment, the total product from the second step in the process is separated into five fractions. The five fractions that are produced in the second step are: (i) a hydrogen-rich gaseous product, (ii) naphtha, (iii) kerosene, (iv) optionally gas oil, and (v) optionally a water-rich product.

The hydrogen-rich gaseous product comprises mainly of unconverted hydrogen that was added to the second step. The use of excess hydrogen compared to stoichiometric requirements is common practice in hydrotreating processes. Much of the unconverted hydrogen-rich gaseous product will be recycled to step two of the process, and some of the hydrogen-rich gaseous product will be purged. The ratio of recycle to purging is a known engineering trade-off. The manner in which the hydrogen-rich gaseous product is obtained, potentially further separated, and recycled are known in the art.

The relative amounts of naphtha, kerosene, and gas oil that are obtained as final products from the second step of the process, may depend on the operation of the first step, as well as on the cut-point temperature selected for the second step. The cut-point temperature between the naphtha and kerosene can be at or around 160° C. This cut-point temperature is selected in accordance with the lower temperature limit at which the kerosene would meet jet fuel specification requirements influenced by low boiling compounds. The cut-point temperature between the kerosene and gas oil can be at or around 260° C. This cut-point temperature is selected in accordance with the upper temperature limit at which the kerosene would meet jet fuel specification requirements influenced by high boiling compounds.

A first aspect of the process described in the present disclosure is related to the control of the aromatic content in the product from the first conversion step. The hydrogen-transfer properties of the acid catalyst can be used through choice of operating conditions to convert alcohols into carbonyls and carbonyls can then be converted into aromatics in parallel with alkene conversion to produce a kerosene product suitable to be a component of fully-formulated jet fuel, or be a fully-formulated jet fuel.

A related aspect of the process described in the present disclosure is the choice of operating conditions for the first step of the process in combination with the ratio of the alcohols in the alcohol-containing feed and the alkenes in the feed to the first step of the process to obtain a product that has a kerosene boiling fraction with an aromatics concentration of 5-35 wt %, or more specifically a hydrocarbon kerosene boiling fraction with 8-26.5 or 8-25 vol % aromatics.

Another aspect of the process described in the present disclosure is that it teaches how to convert an alcohol-containing feed into a kerosene boiling range product that is a fully-formulated aviation turbine fuel that does not require blending with other materials. In the fully-formulated kerosene, the mixture of n-alkanes, isoalkanes, cycloalkanes, and aromatics are within the compositional range of petroleum-derived jet fuel, and within the compositional limits for aviation turbine fuel containing synthesized material.

According to another aspect of the present disclosure, there is provided a method and apparatus that employ only two distinct conversion steps in the process, take an alcohol-containing feed, which equally applies to a feed comprising of ethanol, and produce a kerosene boiling range product that without blending is a fully-formulated aviation turbine fuel.

At the same time, the material produced by the disclosed process can be blended with other kerosene boiling range materials, and such blending is not precluded by the disclosed process. Blending of the kerosene boiling range material from the process of the present disclosure with other kerosene range materials, including petroleum-derived kerosene, can be types of blending to produce fully-formulated jet fuel that are known in the art.

According to another aspect of the present disclosure, there is provided a two-stage process for producing fuel. The process includes, (a) during an acid-catalyzed conversion stage, the steps of providing an alcohol-containing feedstock in the presence of alkenes; performing continuous conversion of alcohols over an acid catalyst, the conversion combining the following two steps: dehydration of alcohols to produce alkenes, and oligomerization of alkenes to produce higher carbon-number alkenes; adjusting at least one of the following factors of the conversion: (i) temperature, (ii) pressure, (iii) flow rate, and (iv) ratio of alcohols to alkenes, thereby regulating production of aromatics during the conversion stage; and separating conversion products into a first plurality of fractions, which comprise a first kerosene fraction, wherein the aromatic content of the first kerosene fraction is within a pre-determined range, and (b) during a hydrotreatment stage, the step of providing a hydrogen gas feed and a conversion-product feed, wherein the conversion-product feed is a portion of the conversion products and comprises the first kerosene fraction; performing hydrogenation of the conversion-product feed; separating hydrotreatment products into a second plurality of fractions, which comprise a second kerosene fraction, wherein the aromatic content of the second kerosene fraction is within the pre-determined range.

In some embodiments, the pre-determined range of the aromatic content of the first and second kerosene fractions is 5-35 wt %, 8-26.5, or 8-25 vol %.

In some embodiments, the fuel is jet fuel. In some embodiments, the jet fuel is fully-formulated and does not require blending with other materials.

In some embodiments, the acid catalyst is a zeolite catalyst. In some embodiments, the zeolite catalyst is H-ZSM-5.

In some embodiments, the process includes the step of testing whether the first kerosene fraction contains its aromatic content within the pre-determined range.

In some embodiments, the at least one of the four factors of the conversion is adjusted based on whether the kerosene fraction contains its aromatic content within the pre-determined range.

In some embodiments, the process includes the step of providing additional alkenes to the conversion to adjust the ratio of alcohols to alkenes. In some embodiments, the additional alkenes are produced from the conversion but outside the kerosene fraction, thereby being recycled to the conversion.

In some embodiments, the additional alkenes are included in a gaseous fraction, in a liquid fraction, or in both, of the first plurality of fractions.

In some embodiments, the first plurality of fractions includes a naphtha fraction. In some embodiments, the conversion-product feed includes the naphtha fraction.

In some embodiments, the conversion includes a hydrogen-transfer reaction with alcohols as hydrogen donor and alkenes as hydrogen acceptor to produce carbonyls and alkanes.

In some embodiments, the conversion includes concomitant aldol condensation and dehydration of carbonyls to produce aromatics.

In some embodiments, the hydrogen-transfer reaction functions as a catalytic pathway to regulate production of aromatics during the conversion.

In some embodiments, the production of aromatics is regulated during the conversion by way of adjusting at least one of the four factors of the conversion thereby modifying the hydrogen-transfer reaction.

In some embodiments, the alcohol-containing feedstock is derived from biomass. In some embodiments, the alcohol-containing feedstock is beer column vapor product comprising about 60% ethanol.

In some embodiments, the rate of alcohol conversion is at least 95% during the acid-catalyzed conversion stage.

In some embodiments, the first kerosene fraction is at least 40 wt % or at least 50 wt % of hydrocarbon products from the conversion stage.

In some embodiments, the hydrogenation is performed over a reduced base metal catalyst. In some embodiments, the reduced base metal catalyst is reduced nickel on alumina support ($Ni/Al_2O_3$).

In some embodiments, one of the four factors of the conversion is adjusted to regulate relative amounts of the second plurality of fractions.

According to another aspect of the present disclosure, there is provided a method for regulating production of aromatics during continuous conversion of alcohols to produce a chemical component. The method includes the steps of: providing an alcohol-containing feedstock in the presence of alkenes; performing continuous conversion of alcohols, the conversion combining the following two steps: dehydration of alcohols to produce alkenes, and oligomerization of alkenes to produce higher carbon-number alkenes; and adjusting at least one of the following factors of the conversion: (i) temperature, (ii) pressure, (iii) flow rate, and (iv) ratio of alcohols to alkenes, thereby regulating production of aromatics.

In some embodiments, the chemical component is fuel.

In some embodiments, the chemical component is fully-formulated jet fuel.

In some embodiments, the production of aromatics is regulated to produce a kerosene fraction having its aromatic content within a pre-determined range. In some embodiments, the pre-determined range of the aromatic content of the kerosene fraction is 5-35 wt %, 8-26.5 vol %, or 8-25 vol %.

In some embodiments, the process includes the step of separating conversion products into a plurality of fractions, which comprise the kerosene fraction. In some embodiments, the process includes the step of testing whether the kerosene fraction contains its aromatic content within the pre-determined range.

In some embodiments, the at least one of the four factors of the conversion is adjusted based on whether the kerosene fraction contains its aromatic content within the pre-determined range.

In some embodiments, the process includes the step of providing additional alkenes to the conversion to adjust the ratio of alcohols to alkenes.

In some embodiments, the additional alkenes are produced from the conversion but outside the kerosene fraction, thereby being recycled to the conversion. In some embodiments, the additional alkenes are included in a gaseous fraction, in a liquid fraction, or in both, among the plurality of fractions. In some embodiments, the plurality of fractions includes a naphtha fraction.

In some embodiments, the continuous conversion is performed over an acid catalyst. In some embodiments, the acid catalyst is a zeolite catalyst. In some embodiments, the zeolite catalyst is H-ZSM-5.

In some embodiments, the conversion includes a hydrogen-transfer reaction with alcohols as hydrogen donor and alkenes as hydrogen acceptor to produce carbonyls and alkanes.

In some embodiments, the conversion includes concomitant aldol condensation and dehydration of carbonyls to produce aromatics.

In some embodiments, the hydrogen-transfer reaction functions as a catalytic pathway to regulate production of aromatics during the conversion.

In some embodiments, the production of aromatics is regulated during the conversion by way of adjusting at least one of the four factors of the conversion thereby modifying the hydrogen-transfer reaction.

In some embodiments of the process or method of the present disclosure, the acid-catalyzed conversion stage employs a conversion unit which comprises two catalytic subunits, where one or more gaseous and/or liquid alkenes obtained from the continuous conversion passes through the first catalytic subunit and then the second catalytic subunit, and where the remainder of the feed material to the acid-catalyzed conversion stage passes only through the second catalytic subunit. The gaseous and/or liquid alkenes react to form longer-chain alkenes in the first catalytic subunit, thereby decreasing the molar concentration of alkenes relative to the molar concentration of the alcohols passing through the second catalytic subunit.

BRIEF DESCRIPTION OF THE DRAWINGS

Features and advantages of embodiments of the present application will become apparent from the following detailed description and the appended drawings, in which.

DETAILED DESCRIPTION

Figure 1:
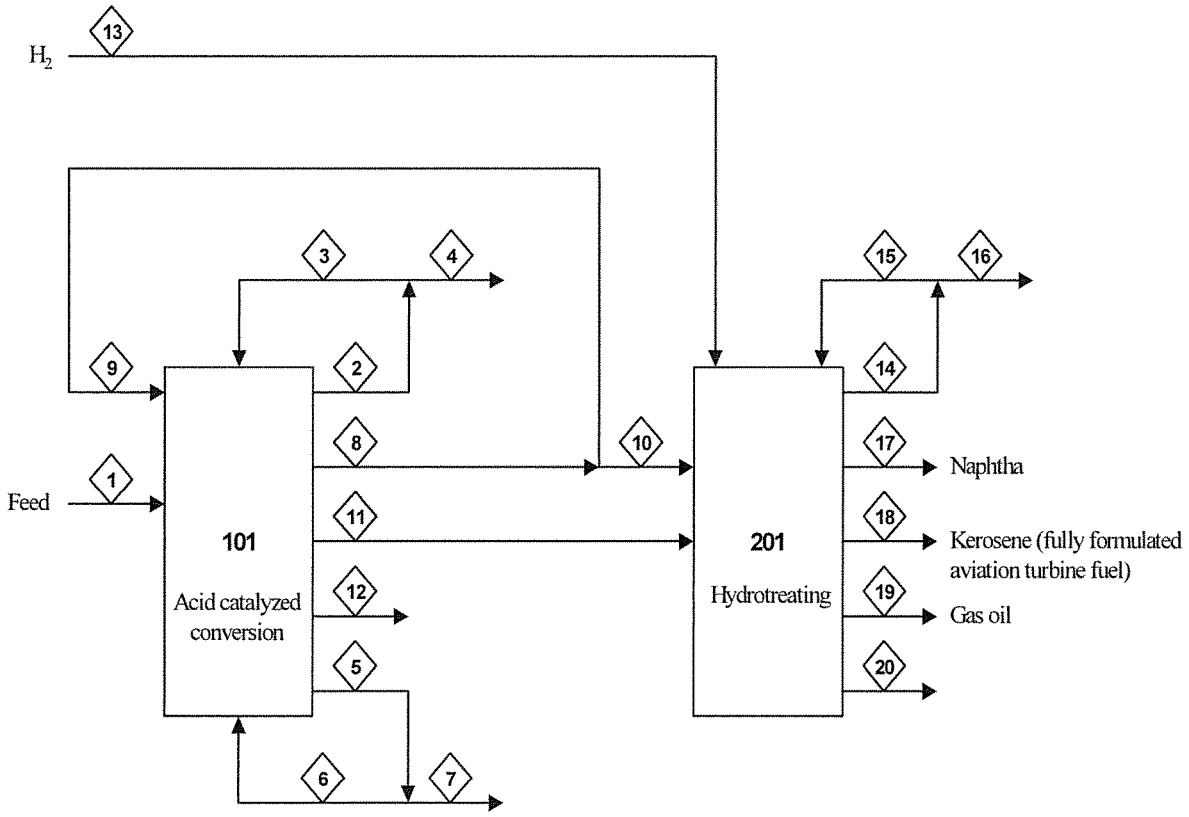
FIG. 1 shows a block flow diagram representation of the process for producing aviation turbine fuel (jet fuel) from an alcohol-containing feedstock.

The description which follows and the embodiments described therein are provided by way of illustration of an example or examples of particular embodiments of the principles of the present invention. In the following description of the invention, numerous examples are provided and specific details are set forth for the purposes of explanation and not limitation in order to provide a thorough understanding of the invention. Those that are skilled in the art will readily appreciate that the well-known methods, procedures and/or components will not be described so as to focus on the invention in question. Accordingly, in some instances, certain structures and techniques have not been described or shown in detail in order not to obscure the invention.

The present disclosure pertains to the surprising discovery that hydrogen transfer from alcohols to alkenes to produce carbonyls and alkanes can be an important catalytic pathway to regulate the composition of a kerosene fraction obtained from an alcohol-based feed. Especially, production of aromatics can be regulated by the hydrogen-transfer reaction through the conversion of carbonyls to aromatics. The aromatic content in kerosene can be effectively controlled on the basis of the foregoing catalytic pathway, thereby enabling transformation of alcohols to fully-formulated synthetic jet fuel.

In addition, the present disclosure provides a two-stage process for producing jet fuel from an alcohol-containing feed, which comprises an acid-catalyzed conversion stage (the first step or stage) and a hydrogenation stage (the second step or stage). The two-stage process of the present disclosure is significant improvement from a conventional three-step process, which requires three separate stages of dehydration, oligomerization, and hydrogenation. In a process of the present disclosure, dehydration and oligomerization can be combined in an integrative manner during the first step. In some embodiments, the two reactions are consolidated in a same reactor during the first step.

The combination of alcohol dehydration that is an endothermic reaction, and alkene oligomerization that is an exothermic reaction, is a benefit derived from performing these reactions together in the same reactor. A further benefit derived from performing these endothermic and exothermic reactions together in the same reactor is to shift the reversible dehydration-hydration reaction equilibrium towards dehydration by continuously converting some of the alkenes produced from the alcohols in the feed to different alkenes. In the present disclosure, it is therefore found that feed alcohol conversion can be high, for example, more than 95% single-pass alcohol conversion.

One of the unique features of the first conversion step of the two-step process of the present disclosure, is how it can be employed to exploit the hydrogen-transfer characteristics of the acid catalyst for alcohol and alkene conversion to a kerosene product suitable for jet fuels, including fully-formulated jet fuels. The transfer of hydrogen from an alcohol to an alkene produces the corresponding carbonyl and alkane as products. This is an important reaction in the present disclosure, with the alcohol being the hydrogen donor and the alkene being the hydrogen acceptor.

Hydrogen transfer reaction can take place during conventional alcohol dehydration, but usually to a minor extent, because hydrogen transfer requires both a hydrogen donor and hydrogen acceptor. During conventional alcohol dehydration, the concentration of alkenes increases only as the concentration of alcohols decreases, thereby limiting the amount of hydrogen transfer.

In the two-stage process of the present disclosure, one or more alkene-input streams can be introduced in addition to an alcohol-feed stream during the first stage. In some embodiments, the first stage is carried out in an acid-catalyzed conversion unit that is configured to receive the alkene-input stream(s) in addition to the alcohol-feed stream. By providing the alkene-input stream(s) to the conversion, the ratio of alcohols to alkenes can be adjusted more effectively, thereby achieving improved control over the composition and/or yield of kerosene product by way of transfer hydrogenation as a catalytic pathway. The one or more alkene-input streams may correspond to one or more recycle streams that include alkenes (e.g., streams 3 and/or 9 of FIG. 1). The alkene recycle stream(s) may comprise ethene or other light olefins in the gaseous and/or liquid state. In some embodiments, hydrogen transfer from alcohols to olefins can be regulated by adjusting at least one of the operating parameters of the acid-catalyzed conversion unit at the first stage. The operating parameters may include reaction temperatures and pressures, flow rates, and the ratios of alcohols (e.g., mainly present in stream 1 of FIG. 1) to alkenes (e.g., mainly present in streams 3 and/or 9 of FIG. 1).

In some embodiments, the acid-catalyzed conversion unit is divided into at least two subunits. The first subunit can be configured to receive one or more alkene recycle streams as input (e.g., streams 33 and/or 39 of FIG. 2) and the second subunit can be configured to receive the alcohol-feed stream as input (e.g., stream 31 of FIG. 2). The first and second subunits are further configured such that the product or products of the first subunit can enter the second subunit as input. Within the first subunit, the input alkenes can be converted to higher carbon-number alkenes, thereby decreasing the molar concentration or the total number of moles of alkenes that exit the first subunit and enter the second subunit. For example, ethene and/or other short-chain alkenes can react to form longer alkenes, preferably in the near absence of water and alcohols:

$$nC_2H_4 \rightarrow C_{2n}H_{4n} (n \text{ moles of alkene} \rightarrow 1 \text{ mole of alkene}).$$

The multiple-subunit configuration of the conversion unit provides additional control over the alcohol-to-alkene ratio with great flexibility. In one embodiment, two subunits can be arranged in series within a single reactor (e.g., as shown in block 301 of FIG. 2). In another embodiment, two subunits can be provided in two different reactors.

The acid-catalyzed conversion unit with multiple subunits may employ the same acid catalyst for all subunits, or may employ different acid catalysts in the different subunits.

The catalyst(s) used in the conversion unit can be introduced by way of the technology known to those skilled in the art (e.g., fixed bed, fluidized bed, etc.). With the teachings of the present disclosure, various design modifications to the acid-catalyzed conversion unit will be available to those skilled in the art, to the extent that multiple subunits of the conversion unit can operate in tandem to increase control over the alcohol-to-alkene ratio, thereby effectively regulating the composition and/or yield of a target kerosene fraction by way of transfer hydrogenation.

The temperature for hydrogen-transfer reaction during the first stage may be lower than the optimum temperature range for an acid catalyst to perform aromatization of alkenes. The pressure for hydrogen-transfer reaction during the first stage may be sufficiently higher than atmospheric pressure to suppress reactions that increase the number of products compared to the number of reagents. For example, the pressure is sufficiently high to cause some suppression of alcohol dehydration. In alcohol dehydration, one molecule of reagent (alcohol) is converted into two molecules of product (alkene and water); in hydrogen transfer, two molecules of reagent (alcohol and alkene) are converted into the same number of molecules of product (carbonyl and alkane).

In this context, the ratio of alcohols to alkenes that promote hydrogen transfer may refer to the combination of concentration values that would give an appropriate reaction rate for the purpose of this disclosure. For example, if the reaction rate is described as a bimolecular second-order reaction, then the highest rate would be when the concentration of alcohols multiplied by the concentration of alkenes is the highest, which is mathematically when there is an equimolar ratio. This may not necessarily be an appropriate reaction rate for the purpose of the present disclosure and the example is provided only to illustrate the concept.

The processes of the present disclosure may employ the concomitant aldol condensation and dehydration of carbonyls to produce aromatics. By doing so, aromatics can be produced at temperature conditions below the temperature conditions that would promote substantial alkene aromatization. The present disclosure teaches how aromatic production can be controlled in relation to alkene oligomerization in the first conversion step to produce a product with 5-35 wt % aromatics in the kerosene boiling range, or more specifically 8-26.5 or 8-25 vol % aromatics suitable for producing fully-formulated jet fuel.

In a process of the present disclosure, alcohols, under acid catalysis, can be converted into carbonyls in parallel with alkene conversion to produce a kerosene product suitable for fully-formulate jet fuel. In addition, alkenes and water, under acid catalysis, can be converted into alcohols and carbonyls in parallel with alkene conversion to produce a kerosene product suitable for fully-formulate jet fuel.

Definitions

The term "jet fuel" or "aviation turbine fuel" refers to a type of aviation fuel designed for use in aircraft powered by gas-turbine engines, which is a mixture of a variety of hydrocarbons. The most commonly used fuels for commercial aviation are Jet A and Jet A-1, which are produced to a standardized international specification. Since the chemical composition of jet fuel varies based on sources, it is defined as a performance specification rather than chemical compounds. In addition, the range of molecular mass or carbon numbers between hydrocarbons is defined by the requirements for the product (e.g., the freezing point, flash point, or smoke point, etc.).

The term "hydrogen transfer" or "transfer hydrogenation" refers to a chemical reaction involving the addition of hydrogen to a compound from a source other than molecular hydrogen ($H_2$). H is transferred from a donor compound to an acceptor compound. It is a movement of a hydride ion ($H^-$) and proton ($H^+$) or two protons and two electrons, or two monoatomic hydrogen radicals ($H\cdot$).

The term "carbonyls" refers to compounds containing a C═O group, which include organic acids, esters, aldehydes and ketones.

The term "oxygenates" means hydrocarbons containing oxygen, i.e., oxygenated hydrocarbons. Oxygenates include alcohols, ethers, carboxylic acids, esters, ketones, and aldehydes, and the like.

The term "fractions" refers to different hydrocarbon components separated by equilibrium stage processes based on their relative molecular weights or boiling points. Different fractions have distinct boiling point or range of boiling points within a tolerance level. They include fuel gas, gasoline, naphtha, kerosene, diesel, gas oil.

The term "space velocity" refers to the relation between volumetric flow rate and reactor volume in a chemical reactor, or the gravimetric flow rate and the weight of catalyst in a chemical reactor. It signifies that how many reactor volumes of feed can be fed in unit time. For example, a reactor with a space velocity of 1 $hr^{-1}$ is able to process feed equivalent to one time the reactor volume each hour.

The term "weight hourly space velocity" (WHSV) is defined as the weight of feed flowing per unit weight of the catalyst per hour.

The term "reaction equilibrium" or "equilibrium" refers to a state in which the rate of the forward reaction equals the rate of the backward reaction. In other words, there is no net change in concentrations of reactants and products.

The phrase "free of" or "substantially free of" is used herein to mean an amount of a compound that is no more than that which would exhibit the undesirable properties in a jet fuel. Typically, this amount is about 2 wt % or less, more typically about 1 wt % or less.

Review of Alcohol-to-Jet (ATJ) Technologies

Countries around the world employ transport fuel specifications to regulate the property requirements for transport fuels. Globally, the specifications for aviation turbine fuel (jet fuel) are substantially the same due to the international nature of air transport.

Fully-formulated kerosene is a mixture of compounds within the kerosene boiling range (typically atmospheric-equivalent boiling point temperature range of 160-260° C., more widely 140-300° C.) comprising of mostly n-alkanes (linear paraffins), isoalkanes (branched paraffins), cycloalkanes (cyclic paraffins, naphthenes), and aromatics. The fully-formulated kerosene is also a fully-formulated aviation turbine fuel (jet fuel) when the properties of the kerosene are within the property specification limits for jet fuel.

When the jet fuel is not produced exclusively from petroleum (crude oil), it is classified as a synthetic jet fuel. The synthetic jet fuel is referred to as sustainable aviation fuel (SAF) when it is produced from biomass and organic wastes that are considered renewable materials that can in principle be replenished in a sustainable way.

Synthetic jet fuel may comprise of mixtures of petroleum and material that is not derived from petroleum. For the jet fuel to be fully formulated, in one standard test method, the jet fuel must contain between eight and twenty-six point five volume percent (8-26.5 vol %) aromatics, with the remainder comprising of a mixture of non-aromatic hydrocarbons comprising mostly of n-alkanes, isoalkanes, and cycloalkanes. This compositional requirement is highlighted, because processes described in the art to produce synthetic jet fuel from alcohols, typically produces a kerosene boiling range product with an aromatic content that falls outside of this 8-26.5 vol % range. In another standard test, the jet fuel must contain between eight and twenty-five volume percent (8-25 vol %) aromatics.

The conversion of alcohols to hydrocarbons has considerable literature. For clarity, it is best to divide the conversion of alcohols into three groups based on the number of carbon atoms in the molecular structure. The three groups are (i) single carbon atom alcohols, such as methanol ($CH_3OH$), (ii) two-carbon alcohols, such as ethanol ($CH_3CH_2OH$), and (iii) alcohols with three or more carbons, for example, n-propanol, isopropanol, n-butanol, 2-butanol, and isobutanol. The grouping is not only scientifically justified, but also necessary to describe what is known in the field.

What makes single carbon alcohol to hydrocarbon conversion unique, is the inability of methanol to be directly dehydrated to an alkene (olefin), which requires two adjacent carbon atoms. Since methanol conversion to alkenes cannot proceed by direct dehydration to the alkene, the first step in such a process attracted significant scientific interest and there are several contending explanations, as noted in the chapter by Xu, et al. "Advances in catalysis for methanol-to-olefins conversion" [1].

Methanol conversion to hydrocarbons has been reviewed in publications such as Chang on "Hydrocarbons from methanol" [2]. As outlined in this review, the description of methanol conversion to hydrocarbons can be traced further back. A second aspect to consider in methanol conversion is that the equilibrium-limited bimolecular dehydration reaction leads to the formation of methoxymethane ($CH_3OCH_3$, dimethyl ether, DME). The same conversion process applied to the alcohol can also be applied to the ether. The reaction sequence is often expressed in this way, with the first step of the methanol conversion to hydrocarbons being the formation of methoxymethane, for example, as explained by Keil in "Methanol-to-hydrocarbons: Process technology" [3], which gives the reaction sequence with elimination of water as:

$$2\ CH_3OH \leftrightarrow CH_3OCH_3 \rightarrow \text{light alkenes} \rightarrow$$

$$\text{heavier alkenes} + n\text{-alkanes} + \text{isoalkanes} + \text{cycloalkanes} + \text{aromatics}$$

Therefore, all of the compound classes in fully-formulated jet fuel can be produced by alcohol conversion.

Two-carbon atom alcohol conversion to hydrocarbons can proceed by direct dehydration of the alcohol to an alkene; specifically, ethanol can be directly dehydrated to ethene ($CH_2CH_2$, ethylene). The equilibrium-limited bimolecular dehydration reaction leads to the formation of ethoxyethane ($CH_3CH_2OCH_2CH_3$, diethyl ether, DEE). This has been known for many years, for example, as expressed by Pease and Yung in "The catalytic dehydration of ethyl alcohol and ether by alumina" [4], or by Bi, et al. in "High effective dehydration of bio-ethanol into ethylene over nanoscale HZSM-5 zeolite catalysts" [5]. The same conversion process applied to the alcohol can also be applied to the ether.

The conversion via direct dehydration to form alkenes can also be applied to alcohols with three or more carbons, for example, as noted by Adkins and Perkins in "Dehydration of alcohols over alumina" [6]. The conditions and equilibrium limitations are different for the different alcohols, but the same principles apply. It was shown that the dehydration reaction can be extended to heavier alcohols, including alcohols in the kerosene boiling range that are dehydrated to ethers or alkenes, for example, Nel and De Klerk in "Dehydration of $C_5$-$C_{12}$ linear 1-alcohols over eta-alumina to fuel ethers" [7]. In summary, dehydration of alcohols with two, three, or more carbons can be performed with high selectivity to the corresponding alkene.

Typically, a hydrocarbon compound requires at least nine carbon atoms to distill in the kerosene boiling range. When the aim is to produce jet fuel from alcohols, alkene oligomerization is necessary when the number of carbon atoms in the alkene produced by alcohol dehydration is too low to cause the compound to distill in the kerosene boiling range. Alkene oligomerization is the addition reaction of the alkenes, which includes dimerization, trimerization, tetramerization, and so forth; in older literature it is also referred to as polymerization, or as telomerization.

Different ways of performing alkene oligomerization were reviewed by Nicholas in "Applications of light olefin oligomerization to the production of fuels and chemicals" [9].

What sets two-carbon alcohol conversion apart from the conversion of alcohols with three or more carbons, is the manner in which alkene oligomerization takes place. Alkene oligomerization is often practiced as an acid-catalyzed conversion process. Acid-catalyzed alkene oligomerization is described in terms of a carbocation (carbenium ion) mechanism as proposed by Whitmore in "Mechanism of the polymerization of olefins by acid catalysts" [8]. When the alkene has only two carbons, the carbocation can only be a primary carbocation. It is more difficult to protonate an alkene to form a primary carbocation than to protonate an alkene to form a secondary or tertiary carbocation. The rate of acid-catalyzed protonation is therefore slower for ethene oligomerization, which can only be protonated to form a primary carbocation, when compared to oligomerization of alkenes with three or more carbon atoms that can be protonated to form a secondary or tertiary carbocation.

Another difference between the oligomerization of ethene and alkenes with three or more carbons is the skeletal structure of the oligomerization products. The products from ethene oligomerization are more likely to be linear addition products, whereas the products from oligomerization of alkenes with three or more carbon atoms are more likely to be branched addition products.

Although fully-formulated synthetic jet fuel includes linear hydrocarbons, the amount of linear hydrocarbons that can be present in the jet fuel is limited by the freezing-point specification. For example, the maximum onset of freezing-point specification for Jet A-1 is minus forty-seven degrees Celsius (–47° C.). When comparing hydrocarbon compounds with the same number of carbon atoms, linear hydrocarbons typically have higher freezing points than either branched or cyclic hydrocarbons.

The oligomerization of propene and heavier alkenes produced by dehydration of alcohols with three or more carbons does not have the shortcomings that were noted for the oligomerization of ethene and acid-catalyzed processes can readily be employed.

One way of overcoming the noted limitations of acid-catalyzed oligomerization of ethene produced by ethanol dehydration, is to employ alkene oligomerization that does not make use of acid catalysis. For example, organometallic catalysis can be employed for the oligomerisation of ethene as described by Chauvin, et al. in "Upgrading of $C_2$, $C_3$, $C_4$ olefins by IFP Dimersol technology" [10]. This approach is highlighted specifically, because this approach is one of the approaches used for alcohol-to-jet conversion. This is not the only approach that can be followed to oligomerize ethene more efficiently to heavier alkenes.

Keeping the fundamental differences between the conversion of the three different groups of alcohols in mind, different strategies have been proposed to convert alcohols into synthetic jet fuel. An overview of processes for the production of synthetic jet fuel can be found in the book titled "Biofuels for Aviation. Feedstocks, Technology and Implementation" [11].

A description of processes for methanol conversion to synthetic jet fuel is notably lacking. This can be explained by looking at the conversion in more detail. At the conditions used for methanol conversion to hydrocarbons, the intermediate light alkene products are not just oligomerized to heavier hydrocarbons, but as Keil described in "Methanol-to-hydrocarbons: Process technology" [3], aromatization takes place. Thus, although all of the compound classes one would anticipate in a fully-formulated jet fuel are present in the product, most of the non-aromatic products have lower boiling points than kerosene. The product in the kerosene boiling range has a high concentration of aromatics. When pressure is increased, which would be a typical strategy to increase the yield of higher-boiling hydrocarbon products, there is a considerable increase in amount of 1,2,4,5-tetramethylbenzene (durene). The increase in 1,2,4,5-tetramethylbenzene with an increase in pressure is explained by Chang, Lang, and Smith in "The conversion of methanol and other O-compounds to hydrocarbons over zeolite catalysts. II. Pressure effects" [12]. The freezing point of 1,2,4,5-tetramethylbenzene is about +77° C., which makes it detrimental to the formulation of jet fuel.

Therefore, methanol conversion to hydrocarbons can produce a product that contains all of the compound classes needed for fully-formulated jet fuel, but that the aromatic concentration in the kerosene is higher than 25 vol % and that the freezing point exceeds –47° C.

Despite the diversity in process routes for ethanol and heavier alcohol conversion, the final products from the different process routes have much in common. The typical nature of the products produced by alcohol-to-jet processes are reflected in the American Society for Testing and Materials "D7566 Standard Specification for Aviation Turbine Fuel Containing Synthesized Hydrocarbons" (ASTM D7566) under the annex titled "Alcohol-to-jet synthetic paraffinic kerosene" (ATJ-SPK) [14]. Although the description does not reflect all of the proposed processes, most of the alcohol-to-jet processes aim to produce a product that can be described as ATJ-SPK. Examples of this include processes as described by Smith, et al. in "Conversion of mixtures of $C_2$-$C_8$ olefins to jet fuel and/or diesel fuel in high yield from bio-based alcohols" [13].

Processes that produce ATJ-SPK as product employ several strategies, which also reflect whether the starting material is ethanol or alcohols with three or more carbons. These are described in broad terms:

(a) Ethanol dehydration to produce ethene and water. The dehydration can be performed over an appropriate dehydration catalyst, which includes various metal oxides, such as alumina, and acid catalysts. Following dehydration, the ethene is separated from the water and the substantially water-free ethene is then oligomerized in a process that is appropriate for ethene oligomerization. This can either be performed in a one-step or two-step oligomerization process. One-step oligomerization of ethene over an acid catalyst to a product that comprises of a wide boiling range of alkenes is possible, for example, by using MFI zeolite framework type catalysts (ZSM-5). Given sufficient residence time to compensate for the slower reaction rate of ethene, it was shown that at the same temperature and pressure conditions, the oligomerization processes of ethene and heavier alkenes are substantially comparable, as noted by Garwood in "Conversion of $C_2$-$C_{10}$ to higher olefins over synthetic zeolite ZSM-5" [15]. Two-step oligomerization is an alternative to the one-step oligomerization. Two-step oligomerization first converts ethene to alkenes with three or more carbon atoms and then secondly, the alkenes with three or more carbon atoms are converted to a product that contains kerosene range material. In the first step, the ethene is oligomerized using an appropriate catalyst for ethene oligomerization, for example, by an organometallic catalyst. In the second step, the alkenes with three or more carbons are oligomerized over an acid catalyst. Both the one-step and two-step oligomerization processes usually employ recycling of alkenes outside of the kerosene boiling range to increase the yield of kerosene boiling range material. The product from alkene oligomerization is then hydrotreated. The product from the hydrotreating of alkenes with added hydrogen ($H_2$) is the corresponding alkanes. The hydrotreated product is distilled to separate the kerosene boiling range material, which can be described as an ATJ-SPK.

(b) Alcohol conversion where the alcohol has three or more carbon atoms is conducted using the same basic steps as employed for ethanol conversion, but without the drawback of having to perform ethene oligomerization. In the first step the alcohol is dehydrated to produce the corresponding alkene and water. Following dehydration the alkenes are separated from the water and then oligomerized in a process that is appropriate for alkene oligomerization. Recycling of alkenes outside of the kerosene boiling range is usually employed to increase the yield of kerosene boiling range material. The product from alkene oligomerization is then hydrotreated with added hydrogen ($H_2$) to produce the corresponding alkanes. The hydrotreated product is distilled to separate the kerosene boiling range material, which can be described as an ATJ-SPK.

When ethanol is the feed, strategies have also been suggested to avoid the process route for ethanol conversion to ATJ-SPK. One approach is to convert the ethanol into heavier alcohols. The Guerbet reaction causes carbon-carbon coupling of two alcohols and in the case of ethanol, the product of the Guerbet reaction is butanol. This effectively changes the starting material from a two-carbon alcohol to an alcohol with three or more carbon atoms. Another approach is to dehydrate the ethanol to ethene, which is then hydroformylated with carbon monoxide and hydrogen to produce propanal ($CH_3CH_2CHO$). The propanal is either hydrogenated as part of the hydroformylation reaction or hydrogenated as a separate step to the corresponding alcohol. This effectively changes the starting material from a two-carbon alcohol to an alcohol with three carbon atoms.

It was recognized that the lack of aromatics in the ATJ-SPK necessitates blending with a source of aromatics to produce fully-formulated jet fuel. It was also recognized that H-ZSM-5 and modified H-ZSM-5 catalysts were capable of producing aromatics.

Aromatics can be produced from methanol, ethanol, or heavier alcohols. This has already been pointed out for methanol. When ethanol is employed as feed, the product contains less 1,2,4,5-tetramethylbenzene, as noted by Chang, Lang, and Smith in "The conversion of methanol and other O-compounds to hydrocarbons over zeolite catalysts. II. Pressure effects" [12]. The fact remains that the product contains little non-aromatic compounds in the kerosene range. For example, Ramasamy and Wang in "Ethanol conversion to hydrocarbons on HZSM-5: Effect of reaction conditions and Si/Al ratio on the product distributions" showed that most of the liquid product from ethanol conversion over H-ZSM-5 in the temperature range 300-400° C. at 2 MPa consisted of aromatics [16]. The low yield non-aromatic hydrocarbons in the kerosene caused the kerosene product to have more than 25 vol % aromatics. A common observation is that under conditions that favor aromatics, the yield of non-aromatic hydrocarbons in the kerosene boiling range is limited.

When alkenes are employed as feed material, the origin of the alkenes is no longer germane to the conversion and it can be described in general terms as hydrocarbon conversion over ZSM-5. This type of process is outlined in work such as that by Chen and Yan "M2 Forming—A process for aromatization of light hydrocarbons" [18].

In summary, all of the compound classes found in fully-formulated jet fuel could be produced by alcohol conversion, but not necessarily in the required proportion for fully-formulated jet fuel. It is known that alcohols can be converted into a kerosene product that comprises mostly of n-alkanes, isoalkanes, and cycloalkanes, but with little or no aromatics. It is also known that alcohols can be converted into a kerosene product that comprises mostly of aromatics, but with little or no non-aromatic hydrocarbons. In one approach, the materials from two (or more) different processes can be combined to produce a kerosene product that is fully formulated and potentially in the required proportion for fully-formulated jet fuel. In another approach, when alcohols are dehydrated, the resulting alkenes can in subsequent steps be converted into fully-formulated kerosene and in this respect, the antecedence of the alkene or alkenes does not affect the alkene conversion to fully-formulated kerosene.

For practical application of alcohol conversion, the alcohol feed material is not necessarily pure and may contain water and other substances. The alcohol feed may also comprise a mixture of alcohols. It may be preferable to convert feed materials that are mixtures of alcohols, water, and other substances directly. Studies employing such feed materials have been reported, for example, Nash, et al. in "Mixed alcohol dehydration over Brønsted and Lewis acidic catalysts" and Tau, et al. in "Methanol to gasoline: Carbon-14 tracer studies of the conversion of methanol/higher alcohol mixtures over ZSM-5" [22]. In the latter, it was found that under the test conditions, all alcohols as sources of carbon had become equivalent and were incorporated into the products indiscriminately. In broader context, it is known in the art that the conversion concept can be extended to other heteroatom containing functional groups, such as the disclosure in Butter, et al. in "Conversion of alcohols, mercaptans, sulfides, halides, and/or amines" [23].

Converting alkenes in the presence of alcohols is implied by dehydration of alcohols, which produces alkenes that are present with the alcohols during the conversion. The oligomerization of alkenes and alcohols, as well as other oxygenates and hydrocarbons to produce a hydrocarbon product that contains kerosene range material is also known, for example, Köhler, et al. in "Converting olefins to diesel—the COD process" [24]. It was shown that a wide range of oxygen-containing substances, which include alcohols, could be converted over ZSM-5 to a range of aliphatic and aromatic hydrocarbons, for example, Fuhse and Bandermann in "Conversion of organic oxygen compounds and their mixtures on H-ZSM-5" [25].

In summary, purified alcohols, mixed alcohols, and mixtures that contain alcohols with water, hydrocarbons, and other oxygenates, can all be converted in analogous ways to predominantly hydrocarbon products.

EMBODIMENTS OF THE INVENTION

Referring to FIG. 1, the disclosed process comprises two conversion processes. The first conversion process is represented by block 101, which is an acid-catalyzed conversion. The second conversion process is represented by block 201, which is conversion by hydrotreating. Each of these conversion processes includes some form of separation, which enables the product from each conversion process to be separated into the different streams indicated.

The materials that can be employed as feed material for the two-stage process are purified alcohols, mixtures of alcohols, mixtures of one or more alcohols and water, mixtures comprising of one or more alcohols with water and hydrocarbons, and any one of the aforementioned materials with non-alcohol oxygen-containing compounds (oxygenates).

For example, the feed material may comprise at least one type of alcohol (e.g., methanol, ethanol, or propanol) or mixed alcohols. The mixed alcohols may include $C_1$-$C_5$ alcohols, $C_1$-$C_4$ alcohols, or $C_1$-$C_3$ alcohols. The mixed alcohols may include ethanol at least 40 vol %, at least 50 vol %, at least 60 vol %, at least 70 vol %, at least 75 vol %, at least 80 vol %, at least 85 vol %, or at least 90 vol %. In one embodiments, the feed material includes 5 vol % methanol, 90 vol % ethanol, and 5 vol % propanol. The propanol may be 2-propanol. In addition, the feed material may be a mixture of alcohols or a mixture of alcohols and water. The content of water in the feed material may be less than 90 wt %, less than 80 wt %, less than 70 wt %, less than 60 wt %, less than 50 wt %, less than 40 wt %, less than 30 wt %, less than 25 wt %, less than 20 wt %, less than 10 wt %. The feed material can include any mixture of 10-100 wt % alcohol or alcohols and 90-0 wt % water that can be contaminated with carbonyls and other oxygenates. In one embodiment, the feed material is a mixture of alcohols without water. In another embodiment, the feed material includes 60 wt % mixed alcohols and 40 wt % water. In yet another embodiment, the feed material is 100% ethanol.

In one non-limiting embodiment, the feed material is beer column vapor product comprising around 60% ethanol. In this embodiment, it is envisioned that the disclosed process and system are integrated with an alcohol production facility that produces ethanol from fermentable raw material, or ligno-cellulosic raw material, which are potentially renewable raw materials. The methods for converting such potentially renewable raw materials into alcohol-containing products are known in the art. The use of potentially renewable raw materials to produce alcohols is of interest if the aim is not only to produce a synthetic jet fuel, but also a synthetic jet fuel that could be described as a sustainable aviation fuel (SAF).

In another non-limiting embodiment, the feed material contains alcohols and potentially contains other oxygenates and hydrocarbons produced from synthesis gas by processes such as methanol synthesis, Fischer-Tropsch synthesis, and related syntheses that produce alcohols as a product. In this embodiment, it is envisioned that the synthesis gas is produced from potentially renewable raw materials. This is of interest if the aim is not only to product a synthetic jet fuel, but also a synthetic jet fuel that could be described as a sustainable aviation fuel (SAF).

There is no implied limitation on the amount of water, hydrocarbons, or oxygenates that may be present in the alcohol-containing feed. There is no implied limitation on the composition of the alcohol, or alcohols in the alcohol-containing feed. However, as those skilled in the art know, the productivity of the process in relation to its feed capacity will deteriorate as the concentration of alcohols reaches low concentration levels.

The alcohol-containing feed, which is denoted as stream 1 in FIG. 1, is pre-heated and pressurized to reactor inlet conditions for the first conversion step, which is denoted by block 101 in FIG. 1. Typical non-limiting reactor inlet conditions are in the temperature range of 275 to 375° C., pressure range of 1 to 10 MPa, and weight hourly space velocity range of 0.5 to 5 $h^{-1}$.

The recycle feeds, which are denoted as streams 3, 6, and 9 in FIG. 1, can be combined with stream 1 before, during, or after entering block 101 and must analogously be pre-heated and pressurized to reactor inlet conditions.

The way in which streams 1, 3, 6, and 9 are processed to achieve reactor inlet conditions are known to those skilled in the art. Typically, a combination of heat exchanging, heating, pumping, and compression will be employed to achieve this.

Conversion of the combination of streams 1, 3, 6, and 9 takes place in block 101. Block 101 contains one or more reactors. For ease of description, an embodiment that employs a single fixed bed (packed bed) reactor is described, but other embodiments may employ multiple reactors. In this embodiment, the reactor is loaded with an appropriate acid catalyst and in the preferred embodiment, the acid catalyst is a zeolite catalyst with the MFI zeolite framework type, commonly known as H-ZSM-5. In a preferred embodiment, the reactor makes provision for alternating periods of conversion and of catalyst regeneration. One complete operating cycle of the reactor consists of a period of conversion followed by a period of catalyst regeneration. It is known that the catalyst will deactivate with time-on-stream during conversion and that activity can be restored by oxidative catalyst regeneration over several cycles. All of this is known in the art. It is similarly known in the art how more than one reactor can be employed in parallel to achieve continuous operation by having one or more reactors in a period of conversion, while one or more reactors are in a period of catalyst regeneration. It is also possible to combine conversion and regeneration into a single reactor configuration, such as employed by a circulating fluidized bed reactor, although this is not considered a preferred embodiment.

The disclosed process may exploit the combination of low operating temperature, high pressure, and the ratio of alcohols (mainly present in stream 1) to alkenes (mainly present in streams 3 and 9) in the feed to control hydrogen transfer. In this context, a low temperature refers to a temperature lower than the temperature range where acid catalysts are expected to perform substantial aromatization of alkenes. In this context, a high pressure refers to a pressure sufficiently higher than atmospheric pressure to meaningfully suppress reactions that increase the number of products compared to the number of reagents. For example, a pressure can be sufficiently high to cause some suppression of alcohol dehydration, where one molecule of reagent (alcohol) is converted into two molecules of product (alkene and water) and, where compared to hydrogen transfer, two molecules of reagent (alcohol and alkene) are converted into the same number of molecules of product (carbonyl and alkane). In this context, the ratio of alcohols to alkenes that promote hydrogen transfer refers to the combination of concentration values that would give an appropriate reaction rate for the purpose of the process. For example, if the reaction rate is described as a bimolecular second-order reaction, then the highest rate would be when the concentration of alcohols multiplied by the concentration of alkenes is the highest, which is mathematically when there is an equimolar ratio. This may not necessarily be an appropriate reaction rate for the purpose of the disclosed process and the example is provided only to illustrate the concept.

Figure 2:
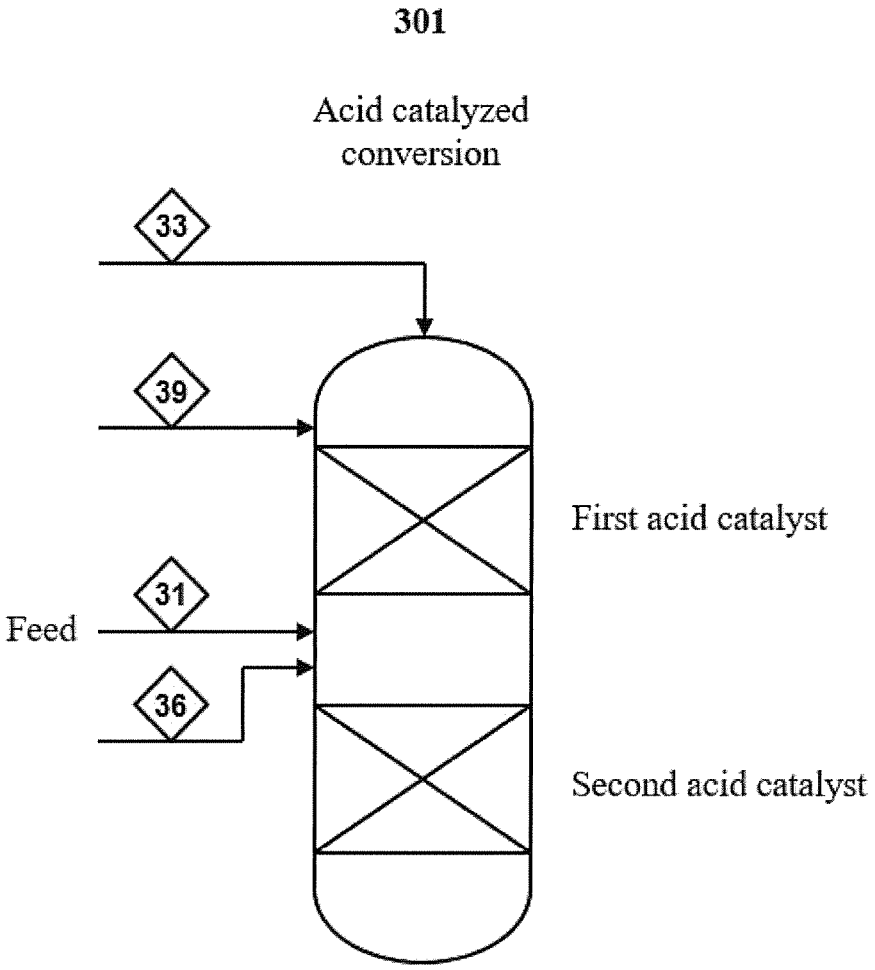
FIG. 2 shows another embodiment of the acid-catalyzed conversion in block 101 of FIG. 1.

FIG. 2 illustrates another embodiment of the acid-catalyzed conversion of block 101 in FIG. 1. Block 301 in FIG. 2 corresponds to block 101 in FIG. 1. Streams 31, 33, 36, and 39 of FIG. 2 correspond to streams 1, 3, 6, and 9 of FIG. 1, thereby showing how streams 1, 3, 6, and 9 of FIG. 1 can be fed to the reactor used for acid-catalyzed conversion as shown in FIG. 2. The output streams of block 101 in FIG. 1 (i.e., streams 2, 4, 5, 7, 8, 10, 11, 12) equally apply to block 301 in FIG. 2. The first acid catalyst and the second acid catalyst can be the same catalyst, or can be selected to be different acid catalysts.

In the embodiment of FIG. 2, the recycles (streams 33 and 39) are fed to a first acid catalyst as indicated in FIG. 2. The product from the conversion over the first acid catalyst is then combined with the alcohol feed (stream 31) and aqueous recycle (stream 36) to be converted over the second acid catalyst. By doing so, there is additional control over the molar ratio of alcohols (mainly present in stream 31) to alkenes (mainly present in streams 33 and 39) in the feed to control hydrogen transfer during conversion over the second acid catalyst.

The alkene molar concentration originating from the recycled alkenes can be decreased as ethene and/or other short-chain alkenes present in the gaseous olefinic recycle react to form longer alkenes in the near absence of water or alcohol. This direct control over the overall molar concentration of alkenes may lead to additional control over the molar ratio of alcohols to alkenes, thereby providing great flexibility to the range of the ratio that can practically obtained in terms of the relative amount of alcohol, water, and alkene feed.

In the embodiment of FIG. 2, the first acid catalyst and the second acid catalyst can be the same type of catalyst (e.g., H-ZSM-5). The first acid catalyst and the second acid catalyst can be different acid catalysts. The amount of the first acid catalyst can be the same as the amount of the second catalyst. The amount of the first acid catalyst can be different from the amount of the second catalyst.

For ease of description, the embodiment shown in FIG. 2 employs a single fixed bed (packed bed) reactor. The amount of the first acid catalyst in relation to alkene-rich recycles (streams 33 and 39) can be selected to reduce the number of moles of alkenes in the recycle streams by alkene oligomerization over the first acid catalyst to change the effective alcohol to alkene molar ratio used for conversion over the second acid catalyst. By implementing the acid-catalyzed conversion in this way, additional control over the extent of hydrogen transfer during the acid-catalyzed conversion in block 301 can be achieved.

The operating parameters and conditions of the acid-catalyzed conversion may depend on the acid catalyst and alcohol feed used. For example, the acid strength of the catalyst may impact selection of the temperature and WHSV; and milder conditions can be used for $C_3$ and heavier alcohol feeds than for methanol or ethanol feeds.

The operating temperature of the first step can be about 150-400° C., about 180-380° C., about 200-380° C., about 250-350° C., about 280-335° C., about 290-335° C., or about 335° C. Below 150° C., an acid catalyst may not be sufficiently active and above 400° C., it may be difficult to prevent or control over-production of aromatics. In some embodiments, with a $C_1$-$C_3$ alcohol feed and H-ZSM-5 as catalyst, the preferred operating temperature range can be 250-350° C.

The operating pressure of the first step can be about 1-10 MPa, about 1-5 MPa, about 1-3.5 MPa, about 1-3 MPa, about 1-2.5 MPa, about 1.5-2.2 MPa, about 2-5 MPa, about 2 MPa, about 3 MPa, about 4 MPa, or about 5 MPa. Below 1 MPa, the reactor volume may become increasingly larger and it can be difficult to form kerosene in adequate yield. Above 10 MPa, the equipment cost may become too expensive to be economically useful. Based on the product's boiling point distribution, it may be preferable to operate at relatively higher pressures (e.g., 5 MPa).

The flow rate of the feed material of the first step can be about 0.1-10 $h^{-1}$, about 0.3-5 $h^{-1}$, about 0.3-1.5 $h^{-1}$, about 0.4-1.2 $h^{-1}$, about 0.5-1 $h^{-1}$, about 0.5-0.9 $h^{-1}$, or about 0.5 $h^{-1}$ as WHSV. The flow rate may be determined on the basis of other reaction conditions including temperature, pressure, catalyst, and feed.

The feed-to-recycle mass ratio can be about 40:60-70:30, about 45:55-66:34, about 50:50-66:34, about 50:50-53:47, or about 50:50.

In one embodiment, the operating temperature, pressure, flow rate, and feed-to-recycle mass ratio of the first step are about 180-380° C., about 0.5-3.5 MPa, about 0.3-1.5 $h^{-1}$ as WHSV, and about 40:60-70:30, respectively. In another embodiment, the operating temperature, pressure, flow rate, and feed-to-recycle mass ratio of the first step are about 280-335° C., about 1.5-2.2 MPa, about 0.5-0.9 $h^{-1}$ as WHSV, and about 50:50-66:34, respectively. In yet another embodiment, the operating temperature, pressure, flow rate, and feed-to-recycle mass ratio of the first step can be one of the following combinations: (i) about 335° C., about 2.0 MPa, about 0.5 $h^{-1}$ as WHSV, and about 50:50, respectively;

(ii) about 280° C., about 2.0 MPa, about 0.9 $h^{-1}$ as WHSV, and about 53:47, respectively; and (iii) about 290° C., about 2.0 MPa, about 0.74 $h^{-1}$ as WHSV, and about 66:34, respectively.

The operating parameters and conditions of the acid-catalyzed conversion can be regulated and optimized on the basis of analysis of one or more product streams of the first step. Referring to FIG. 1 (and also FIG. 2), the gaseous product (stream 2) may be analyzed to assess the progress of the alcohol-to-alkene conversion. The gaseous product may be mostly olefinic but may also include alkanes, which can be indicative of hydrogen transfer. For example, an alkene-to-alkane ratio (e.g., propene-to-propane ratio) can be measured. In addition, the aqueous product (stream 5) may be analyzed to assess the degree of completion of alcohol-to-alkene conversion. In some embodiments, the aqueous product may contain the remaining alcohols, a low concentration of carbonyl compounds such as acetone and butanone. Furthermore, the combined organic liquid products (streams 8, 11, and 12) may be analyzed to evaluate the chemical composition and yield of $C_9$-$C_{15}$ hydrocarbons in the kerosene boiling range. It is known from the art that, directionally, the amount of kerosene can be increased by performing the acid-catalyzed conversion at relatively lower temperature and/or higher pressure. The analysis of the combined organic liquid products (streams 8, 11, and 12) may also reveal whether or not it is likely that the kerosene fraction that will be produced (stream 18) is fully formulated.

Stream 1 (or stream 31) represents the alcohol-containing feed to the first step, block 101 (or block 301).

Stream 2 represents the gaseous product from the first step, block 101 (or block 301). Part of stream 2 is recycled as stream 3 (or stream 33) to the first step, block 101 (or block 301). Part of stream 2 is not recycled and becomes stream 4, which can be employed for other purposes.

Stream 5 represents the aqueous product from the first step, block 101 (or block 301). Part of stream 5 is recycled as stream 6 (or stream 36) to the first step, block 101 (or block 301). Part of stream 5 is not recycled and becomes stream 7, which can be employed for other purposes.

Stream 8 represents the first organic liquid product from the first step, block 101 (or block 301). Part of stream 8 is recycled as stream 9 (or stream 39) to the first step, block 101 (or block 301). Part of stream 8 is not recycled and becomes stream 10, which becomes a feed to the second step, block 201. Optionally stream 10 can be employed for other purposes without becoming a feed to block 201.

Stream 11 represents the second organic liquid product from the first step, block 101 (or block 301). Stream 11 becomes a feed to the second step, block 201.

Stream 12 represents the third organic liquid product from the first step, block 101 (or block 301).

Stream 13 represents hydrogen ($H_2$), which is an added feed material to the second step, block 201.

Stream 14 represents a hydrogen-rich gaseous product from the second step, block 201. Part of stream 14 is recycled as stream 15 to the second step, block 201. Part of stream 14 is not recycled and becomes stream 16, which can be employed for other purposes.

Stream 17 represents the naphtha product from the second step, block 201.

Stream 18 represents the kerosene product from the second step, block 201. This kerosene product is a fully formulated aviation turbine fuel.

Stream 19 represents the gas oil product from the second step, block 201.

Stream 20 represents the water-rich product from the second step, block 201.

The product from conversion in the first step is separated into five fractions. In a typical design that would be known to those skilled in the art, the product from the reactor or reactors in block 101 (or block 301) is cooled down to substantially condense the water in the product. The water is condensed with the organic material that will condense at the same temperature and pressure conditions. This leaves a gaseous product comprising mainly of light hydrocarbons, stream 2 in FIG. 1, in the vapor phase, with the rest of the product being present in the liquid phase.

The gaseous product, stream 2, is recycled as stream 3 (or stream 33) to become part of the feed to the reactor or reactors in block 101 (or block 301). In the event that there are species present in stream 2 that will cause a buildup of such species over time due to the recycle, some of the material in stream 2 must be purged from the recycle loop as stream 4. This practice is known in the art. Stream 2 may also be further treated and separated in accordance with the art causing stream 3 (or stream 33) and stream 4 to have different compositions from each other.

The liquid phase product can be phase-separated into an aqueous liquid product comprising mainly of water and oxygen-containing species dissolved in the water, and an organic liquid comprising mainly of hydrocarbons.

The aqueous liquid product is represented by stream 5. Part of stream 5 is recycled as stream 6 (or stream 36) to become part of the feed to the reactor or reactors in block 101 (or block 301), while the remainder is stream 7. Stream 5 may also be further treated and separated in accordance with the art causing stream 6 (or stream 36) and stream 7 to have different compositions from each other. Stream 7 maintains water balance in block 101 (or block 301) by removing water to the same amount as introduced in the feed and produced during reaction.

In one non-limiting embodiment, stream 7 is treated and reused in the alcohol production process that produced the alcohol-containing feed for this process.

In another non-limiting embodiment, stream 7 is a wastewater product that is dealt with in ways known in the art.

The organic liquid product from the first conversion step is separated into three fractions. The first organic liquid is stream 8, the second organic liquid is stream 11, and the third organic liquid is stream 12.

The first organic liquid, stream 8, comprises mainly of hydrocarbons together with some oxygen-containing compounds with an atmospheric-equivalent boiling point lower than the kerosene boiling range. This fraction is commonly referred to as naphtha and if distillation is employed as method of separation, a typical cut-point temperature is around 160° C. The cut-point temperature denotes the atmospheric-equivalent boiling point temperature of the material with the highest boiling point in stream 8. This is a non-limiting indication of the cut-point temperature, which may be lower or higher than 160° C. Part of stream 8 is recycled as stream 9 (or stream 39) to become part of the feed to the reactor or reactors in block 101 (or block 301). The remainder, stream 10, can be used as feed to the second conversion step in the process in block 201. Optionally, part of or all of stream 10 can be produced as a final product.

In one non-limiting embodiment, stream 10 is employed as a blend component for motor-gasoline.

In another non-limiting embodiment, stream 10 is a fully-formulated motor-gasoline that can potentially be designated a sustainable motor-gasoline.

The second organic liquid, stream 11, comprises mainly of hydrocarbons and includes material in the kerosene boiling range. The hydrocarbons include, but without limitation, alkenes, alkanes, and aromatics. Stream 11 is employed as feed to the second conversion step in block 201.

The separation of a third organic liquid, stream 12, is optional. The desirability of separating stream 12 as third organic liquid depends on the nature of the organic liquid product produced in block 101 (or block 301). The disclosure teaches broadly how to convert alcohol-containing feed materials. Some alcohol-containing feed materials, those containing methanol in particular, are prone to the formation of durene. This was already pointed out in the prior art. It was also pointed out in the prior art that durene is detrimental to the purpose of the disclosed process. The combination of alcohol-containing feed and operating conditions may cause durene to be produced at a concentration in the kerosene that would be detrimental to aviation turbine fuel properties. Analogously, the product may contain n-alkanes at a concentration in the kerosene that would be detrimental to aviation turbine fuel properties. The intent with the separation of a third organic liquid product is to separate material that is considered deleterious to the properties of kerosene.

Stream 12 can be produced as a final product, or it can be processed in ways known in the art to convert stream 12 into products with properties useful to transport fuels. For example, durene in stream 12 can be transalkylated with naphtha boiling range material in stream 10 to produce a product with substantially reduced amount of durene.

The liquid feed material to the second conversion step that forms part of block 201 in FIG. 1, are the organic liquid products in stream 10 and stream 11, part of stream 10 and stream 11, or stream 11. The liquid feed comprises of mainly hydrocarbons and may contain some non-hydrocarbons and oxygenates in particular. The presence of oxygenates in the liquid feed is not a desirable embodiment. Although this feed material is referred to as an organic liquid feed, once this organic liquid is pre-heated and pressurized to reactor inlet conditions for the second conversion step, some or all of the previously liquid feed material may be present in the vapor phase.

The second conversion step in block 201 is a hydrotreater. Block 201 contains one or more reactors, which are collectively referred to as a hydrotreater. For the purpose of hydrotreating, an external source of hydrogen ($H_2$) is supplied, which is represented by stream 13. The use and recycling of hydrogen in a hydrotreater is known in the art. Briefly, the amount of hydrogen that is supplied is in excess of stoichiometric requirement for the conversion. The unconverted hydrogen leaves the conversion step as stream 14, part of stream 14 is recycled as stream 15, the remainder being purged as stream 16. The combined hydrogen-containing feed to the second conversion step in block 201 therefore comprises of stream 13 and stream 15.

In a preferred non-limiting embodiment, the hydrogen in stream 13 is obtained from potentially renewable raw materials using a potentially renewable source of energy.

The methods by which streams 10, 11, 13, and 15 can be pre-heated and pressurized to reactor inlet conditions are known in the art. The design and operation of a hydrotreating reactor or hydrotreating reactors are known in the art. The way in which streams 10, 11, 13, and 15 are introduced to the reactor or reactors are also known in the art.

For ease of description, an embodiment that employs a single fixed bed (packed bed) reactor is described. The reactor is loaded with an appropriate hydrotreating catalyst and in the preferred embodiment, the hydrotreating catalyst is nickel supported on alumina ($Ni/Al_2O_3$) and the catalyst is activated by reduction using hydrogen. The active hydrotreating catalyst is a reduced nickel on alumina. It is known in the art that other reduced metal catalysts can be employed for hydrotreating, for example, platinum on silica. It is also known in the art that other sulfided metal catalysts can be employed for hydrotreating, for example, nickel-molybdenum on alumina. Hydrotreating and its associated heat management, as it is required by the disclosed process, is known in the art.

Typical non-limiting reactor inlet operating conditions for a hydrotreater employing a nickel on alumina catalyst are in the temperature range of 150 to 200° C., pressure range of 1 to 10 MPa, weight hourly space velocity (WHSV) range of 0.5 to 5 $h^{-1}$, and hydrogen-to-liquid feed ratio range of 500 to 1000 $m^3/m^3$ (normal cubic meters of hydrogen gas per cubic meter of organic liquid feed).

The purpose of hydrotreating the feed is to substantially convert alkenes to alkanes, without substantially converting aromatics to cycloalkanes. This is a non-limiting statement of purpose, because in some instances it may be of use to convert some aromatics to cycloalkanes. The intent is to produce a hydrotreated product that is sufficiently hydrotreated for the kerosene boiling range material to meet the oxidative thermal stability requirements for jet fuel.

The product from conversion in the second step is separated into three fractions, but potentially five fractions, as will be explained. In a typical design that would be known to those skilled in the art, the product from the reactor or reactors in block 201 is cooled down to substantially condense all of the products except for the unconverted hydrogen, and potentially some low boiling hydrocarbons. This uncondensed hydrogen-containing gaseous product is stream 14, which has already been described. The condensed liquid product comprises of an organic liquid product and potentially a water-rich product.

The organic liquid product is further separated into different fractions based on boiling point. This type of separation is known in the art and is typically performed by distillation. The lowest boiling organic liquid product is the naphtha, stream 17. A typical cut-point temperature is around 160° C. The cut-point temperature denotes the atmospheric-equivalent boiling point temperature of the material with the highest boiling point in stream 17. This is a non-limiting indication of the cut-point temperature, which may be lower or higher than 160° C.

In a non-limiting embodiment, stream 17 is employed as a blend component for motor-gasoline.

In another non-limiting embodiment, stream 17 is employed as a blend component for petroleum to reduce viscosity and density to facilitate pipeline transport. For example, stream 17 can be employed as diluent for oil sands bitumen.

The kerosene boiling range product is obtained as stream 18. The intended distillation range of stream 18 is such that the kerosene will meet requirements for jet fuel. As is known in the art, the lowest boiling material that is included in the kerosene will be determined by the flash-point specification. No portion of the material in stream 18 may have an atmospheric-equivalent boiling point exceeding 300° C.

In the disclosed process, the product separated as stream 18 is fully-formulated kerosene and the fully-formulated kerosene is also a fully-formulated aviation turbine fuel (jet fuel). Stream 18 comprises mostly of a mixture of n-alkanes, isoalkanes, cycloalkanes, and aromatics that are within the compositional range and property limits of petroleum-derived jet fuel, and within the compositional limits and property limits for aviation turbine fuel containing synthesized material. Stream 18 is produced from stream 1 (or stream 31) by employing only two distinct conversion steps.

Although a person skilled in the art may elect to blend stream 18 with other kerosene range products, it is not required to obtain fully-formulated kerosene that is also a fully-formulated jet fuel.

In one non-limiting embodiment, stream 18 is employed as a blend component for jet fuel.

In another non-limiting embodiment, stream 18 is employed as a fully-formulated jet fuel.

In another non-limiting embodiment, stream 18 is employed as a blend component for diesel fuel.

In another non-limiting embodiment, stream 18 is employed as a fully-formulated diesel fuel.

In another non-limiting embodiment, stream 18 is employed as a fully-formulated diesel fuel that is suitable for winter use in arctic conditions.

The boiling point distribution of the organic liquid product from conversion in block 201 is influenced by the operating conditions and separation performed in block 101 (or block 301). It is known that operating at higher pressure will cause an increase in the production of higher boiling material in block 101 (or block 301). Since the pressure is not considered limiting to the disclosed process, a person skilled in the art may elect to employ a pressure that does not cause the organic liquid product to contain species with a boiling point temperature higher than 300° C. In this case, the practitioner may decide that it is not necessary to obtain gas oil, stream 19, as a separate product.

In one non-limiting embodiment, stream 19, or a mixture of stream 18 and stream 19, is employed as a blend component for diesel fuel.

In another non-limiting embodiment, stream 19, or a mixture of stream 18 and stream 19, is employed as a fully-formulated diesel fuel.

In another non-limiting embodiment, stream 19, or a mixture of stream 18 and stream 19, is employed as a fully-formulated diesel fuel that is suitable for winter use in arctic conditions.

In the event that the feed material contains oxygenates, the hydrotreater has the additional purpose of converting oxygenates into hydrocarbons and water. In this case, stream 20 is a water-rich product that is phase-separated from the organic liquid product from the hydrotreater in block 201.

In a preferred embodiment, conversion and separation in block 101 (or block 301) is performed in a way that no oxygenates are present in stream 10 and stream 11. In that case, when there is an absence of oxygenates in the feed to the hydrotreater, stream 20 is not produced.

Additional Embodiments of the Invention

In one aspect of the present disclosure, there is provided a system for producing fuel. The system includes a converter comprising at least one conversion vessel, the converter configured for receiving an alcohol-containing feedstock and one or more alkene input streams as conversion feeds in the conversion vessel; the conversion vessel configured for conducting conversion of alcohols in the presence of alkenes, the conversion comprising multiple chemical reactions including: dehydration of alcohols to produce alkenes, and oligomerization of alkenes to produce higher carbon-number alkenes; a controller element configured for adjusting at least one of the following factors: (i) temperature of the conversion vessel, (ii) pressure of the conversion vessel, (iii) flow rate, and (iv) ratio of alcohols to alkenes in the conversion feeds, so as to modulate the aromatic content of a first kerosene fraction within a pre-determined range; and a separator configured for separating conversion products into a plurality of fractions, which comprise the first kerosene fraction.

In some embodiments, the system further includes a recycle loop configured for each alkene input stream. In some embodiments, the recycle loop comprises an input unit and an output unit, the output unit adapted for alkenes outside of the first kerosene fraction to exit the conversion vessel and the input unit is adapted for the same alkenes to re-enter the conversion vessel.

In some embodiments, the system includes a hydrotreater comprising at least one hydrotreatment vessel. The hydrotreater is configured for receiving a hydrogen gas feed and a portion of the conversion products comprising the first kerosene fraction as hydrogenation feeds; and the hydrotreatment vessel is configured for conducting hydrogenation with the hydrogenation feeds under operating conditions suitable for obtaining a second kerosene fraction having its aromatic content within the pre-determined range.

In some embodiments, the system includes a tester element configured for testing whether the first kerosene fraction contains its aromatic content within the pre-determined range.

In some embodiments, the multiple chemical reactions during the conversion further include a hydrogen-transfer reaction with alcohols as hydrogen donor and alkenes as hydrogen acceptor to produce carbonyls and alkanes. In some embodiments, the multiple chemical reactions during the conversion further include concomitant aldol condensation and dehydration of carbonyls to produce aromatics. In some embodiments, the hydrogen-transfer reaction functions as a catalytic pathway to regulate production of aromatics during the conversion.

In some embodiments, the controller element is capable of regulating production of aromatics during the conversion by way of adjusting at least one of the four factors thereby modifying the hydrogen-transfer reaction.

In some embodiments, the pre-determined range of the aromatic content of the first and second kerosene fractions is 5-35 wt %, 8-26.5, or 8-25 vol %. In other embodiments, the aromatic content comprises alkyl mononuclear aromatics. In yet other embodiments, the aromatic content is substantially free of dinuclear aromatics.

In some embodiments, the fuel is a component of a fully-formulated jet fuel. In some embodiments, the fuel does not require blending with other materials.

In some embodiments, the conversion vessel is a fixed bed reactor.

In some embodiments, the reactor is loaded with an acid catalyst. In some embodiments, the acid catalyst is a zeolite catalyst. In some embodiments, the zeolite catalyst is H-ZSM-5.

In some embodiments, the converter comprises multiple fixed bed reactors.

In some embodiments, the alcohol-containing feedstock is derived from biomass. In some embodiments, the alcohol-containing feedstock is beer column vapor product comprising about 60% ethanol.

In another aspect of the present disclosure, there is provided a two-stage process for producing jet fuel. The process includes (a) during an acid-catalyzed conversion stage, the steps of providing an alcohol-containing feedstock; performing continuous conversion of alcohols over an acid catalyst, the conversion combining the following two steps: dehydration of alcohols to produce alkenes, and oligomerization of alkenes to produce higher carbon-number alkenes; separating conversion products into a first plurality of fractions, which comprise a first kerosene fraction, and (b) during a hydrotreatment stage, the steps of providing a hydrogen gas feed and a conversion-product feed, wherein the conversion-product feed is a portion of the conversion products and comprises the first kerosene fraction; performing hydrogenation of the conversion-product feed; and separating hydrotreatment products into a second plurality of fractions, which comprise a second kerosene fraction.

In some embodiments, the process includes the step of recovering the second kerosene fraction and blending with aromatics to produce fully-formulated jet fuel.

In some embodiments, the acid catalyst is a zeolite catalyst. In some embodiments, the zeolite catalyst is H-ZSM-5.

In some embodiments, the first plurality of fractions includes a naphtha fraction. In some embodiments, the conversion-product feed includes the naphtha fraction.

In some embodiments, the alcohol-containing feedstock is derived from biomass. In some embodiments, the feedstock is beer column vapor product comprising about 60% ethanol.

In some embodiments, the hydrogenation is performed over a reduced base metal catalyst. In some embodiments, the reduced base metal catalyst is reduced nickel on alumina support ($Ni/Al_2O_3$).

In another aspect of the present disclosure, there is provided a process for producing a chemical component. The process includes the steps of providing an alcohol-containing feedstock; performing continuous conversion of alcohols over an acid catalyst, the conversion combining the following two steps: dehydration of alcohols to produce alkenes, and oligomerization of alkenes to produce higher carbon-number alkenes; and separating conversion products into a plurality of fractions.

FURTHER EMBODIMENTS OF THE INVENTION

In one aspect of the present disclosure, there is provided a process for producing a chemical component from an alcohol-containing feed. The process may comprises: (a) performing, over a first catalyst, continuous conversion of an alcohol reactant present in the alcohol-containing feed, wherein the continuous conversion combines the following two steps: (i) dehydration of the alcohol reactant to produce a first alkene product and water, and (ii) oligomerization of a first portion of the first alkene product to form a second alkene product with a carbon number higher than that of the first alkene product; (b) obtaining a second portion of the first alkene product from the continuous conversion; (c) reacting, over a second catalyst, the second portion of the first alkene product obtained from the continuous conversion to form a third alkene product which has a carbon number higher than that of the first alkene product, whereby the molar concentration of the third alkene product is lower than the molar concentration of the second portion of the first alkene product obtained from the continuous conversion; (d) returning the third alkene product to the continuous conversion; and (e) recovering a target fraction for the chemical component on the basis of one or more pre-determined property requirements of the chemical component.

In some embodiments, the first and second catalysts are the same or different acid catalysts.

In some embodiments, the target fraction includes a kerosene boiling range product. In other embodiments, the target fraction is recovered for subsequent hydrotreatment. In yet other embodiments, the one or more pre-determined property requirements are relevant to jet fuel, more specifically, fully-formulated jet fuel.

The process may further comprises: (f) adjusting at least one of the operating conditions of step (c): (i) temperature, (ii) pressure, and (iii) flow rate. The process may also comprise: (g) testing whether the target fraction meets the one or more pre-determined property requirements of the chemical component, prior to step (f).

In some embodiments, the alcohol-containing feed comprises ethanol. The second portion of the first alkene product obtained from the continuous conversion may comprise ethene and other light alkenes in the gas state. In other embodiments, the target fraction comprise a kerosene fraction, which may be substantially free of durene with aromatics at 8-25 vol %, 10-23 vol %, or 15-20 vol %.

EXAMPLES

Example 1

The feed (stream 1 in FIG. 1) comprised of mixed alcohols, 5 vol % methanol, 90 vol % ethanol, and 5 vol % 2-propanol. The gaseous recycle (stream 3 in FIG. 1) comprised of ethene. The flow rates of these streams were equal on a mass basis. The acid-catalyzed conversion (block 101 in FIG. 1) was performed using H-ZSM-5 as catalyst operated at an average temperature of 335° C., 2 MPa gauge pressure, and WHSV of 0.5 h−1.

Analysis of the gaseous product (stream 2 in FIG. 1) confirmed that the gaseous product comprised mostly of ethene. Additionally, some $C_3$ and heavier hydrocarbons were present.

Analysis of the aqueous product (stream 5 in FIG. 1) revealed that alcohol conversion was near complete. In addition to the remaining alcohols, the aqueous product also contained a low concentration of carbonyl compounds such as acetone and butanone.

Analysis of the combined organic liquid products (streams 8, 11, and 12 in FIG. 1) indicated that on average 50 wt % of the product was $C_9$-$C_{15}$ hydrocarbons in the kerosene boiling range. It is known from the art that, directionally, the amount of kerosene can be increased by performing the acid-catalyzed conversion (block 101 in FIG. 1) at lower temperature and/or higher pressure.

The kerosene was fully formulated and contained 25 wt % non-durene aromatics. The aromatics comprised of alkyl mononuclear aromatics. Dinuclear aromatics were near absent according to gas chromatographic analysis performed on the organic liquid products.

Example 2

The feed (stream 1 in FIG. 1) comprised of 60 wt % mixed alcohols and 40 wt % water. The mixed alcohol composition was 5 vol % methanol, 90 vol % ethanol, and 5 vol % 2-propanol. The gaseous recycle (stream 3 in FIG. 1) comprised of ethene. The mass ratio of the flow rate of the feed to gaseous recycle was 53:47. The acid-catalyzed conversion (block 101 in FIG. 1) was performed using a H-ZSM-5 catalyst operated at an average temperature of 280° C., 2 MPa gauge pressure, and WHSV of 0.9 h−1.

Under these test conditions, the conversion of ethanol was not complete based on analysis of the aqueous product (stream 5 in FIG. 1). The gaseous product (stream 2 in FIG. 1) comprised of 90 wt % ethene, the remainder comprising of $C_3$ and heavier hydrocarbons. No methane was detected. Although the gaseous product was mostly olefinic, there was evidence of hydrogen transfer. For example, the propene-to-propane ratio was 10:1.

The kerosene fraction in the organic liquid product (streams 8, 11, and 12 in FIG. 1) was fully formulated and contained alkenes, alkanes, cycloalkanes, and aromatics. The durene-free kerosene product had an aromatics content of 25 wt %. With durene included, the total aromatics content was 31 wt %. Three alkyl naphthalene isomers were detected, but combined were <0.5 wt % of the kerosene product.

Example 3

The feed (stream 1 in FIG. 1) comprised of 60 wt % mixed alcohols and 40 wt % water. The mixed alcohol composition was 5 vol % methanol, 90 vol % ethanol, and 5 vol % 2-propanol. The gaseous recycle (stream 3 in FIG. 1) comprised of ethene. The mass ratio of the flow rate of the feed to gaseous recycle was 66:34. The acid-catalyzed conversion (block 101 in FIG. 1) was performed using a H-ZSM-5 catalyst operated at an average temperature of 290° C., 2 MPa gauge pressure, and WHSV of 0.74 $h^{-1}$.

The products formed were comparable to Example 2. The kerosene fraction in the organic liquid product (streams 8, 11, and 12 in FIG. 1) was fully formulated and had a non-durene aromatics content of 23 wt %.

REFERENCES

1. Xu, S., et al. Advances in catalysis for methanol-to-olefins conversion. *Adv. Catal.* 2017, 61, 37-122.
2. Chang, C. D. Hydrocarbons from methanol. *Catal. Rev. Sci. Eng.* 1983, 25, 1-118.
3. Keil, F. J. Methanol-to-hydrocarbons: Process technology. *Microporous Mesoporous Mater.* 1999, 29, 49-66.
4. Pease, R. N.; Yung, C. C. The catalytic dehydration of ethyl alcohol and ether by alumina. *J. Am. Chem. Soc.* 1924, 46, 390-403.
5. Bi, J., et al. High effective dehydration of bio-ethanol into ethylene over nanoscale HZSM-5 zeolite catalysts. *Catal. Today* 2010, 149, 143-147.
6. Adkins, H.; Perkins, P. P. Dehydration of alcohols over alumina. *J. Am. Chem. Soc.* 1925, 47, 1163-1167.
7. Nel, R. J. J.; De Klerk, A. Dehydration of $C_5$-$C_{12}$ linear 1-alcohols over eta-alumina to fuel ethers. *Ind. Eng. Chem. Res.* 2009, 48, 5230-5238.
8. Whitmore, F. C. Mechanism of the polymerization of olefins by acid catalysts. *Ind. Eng. Chem.* 1934, 26, 94-95.
9. Nicholas, C. P. Applications of light olefin oligomerization to the production of fuels and chemicals. *Appl. Catal. A* 2017, 543, 82-97.
10. Chauvin, Y., et al. Upgrading of $C_2$, $C_3$, $C_4$ olefins by IFP Dimersol technology. *Erdöl, Erdgas, Kohle* 1990, 106 (7/8), 309-315.
11. *Biofuels for Aviation. Feedstocks, Technology and Implementation*; Chuck, C. J. Ed.; Academic Press: Amsterdam, 2016.
12. Chang, C. D., et al. The conversion of methanol and other O-compounds to hydrocarbons over zeolite catalysts. II. Pressure effects. *J. Catal.* 1979, 56, 169-173.
13. Smith, J. O. et al. Conversion of mixtures of $C_2$-$C_8$ olefins to jet fuel and/or diesel fuel in high yield from bio-based alcohols. U.S. Pat. No. 11,078,433 issued to Gevo Inc., Aug. 3, 2021.
14. ASTM International. ASTM D7566-21, Standard specification for aviation turbine fuel containing synthesized hydrocarbons; ASTM International: West Conshohocken, PA, 2021.
15. Garwood, W. E. Conversion of $C_2$-$C_{10}$ to higher olefins over synthetic zeolite ZSM-5. *ACS Symp. Ser.* 1983, 218, 383-396.
16. Ramasamy, K. K.; Wang, Y. Ethanol conversion to hydrocarbons on HZSM-5: Effect of reaction conditions and Si/Al ratio on the product distributions. *Catal. Today* 2014, 237, 89-99.
17. De Klerk, A. Fischer-Tropsch jet fuel process. U.S. Pat. No. 10,011,789 issued to Sasol Technology, Jul. 3, 2018.
18. Chen, N. Y.; Yan, T. Y. M2 Forming—A process for aromatization of light hydrocarbons. *Ind. Eng. Chem. Proc. Des. Dev.* 1986, 25, 151-155.
19. De Klerk, A., et al. A process for producing synthetic jet fuel. WO Publication No. 2020/154810 by Greenfield Global, Aug. 6, 2020.
20. Lilga, M., et al. Systems and processes for conversion of ethylene feedstocks to hydrocarbon fuels. WO Publication No. 2016/067032 by Battelle Memorial Institute, May 6, 2016.
21. Nash, C. P., et al. Mixed alcohol dehydration over Brønsted and Lewis acidic catalysts. *Appl. Catal. A* 2016, 510, 110-124.
22. Tau, L. M., et al. Methanol to gasoline: Carbon-14 tracer studies of the conversion of methanol/higher alcohol mixtures over ZSM-5. *Fuel Process. Technol.* 1990, 26, 209-219.
23. Butter, S. A., et al. Conversion of alcohols, mercaptans, sulfides, halides, and/or amines. U.S. Pat. No. 3,894,107 issued to Mobil Oil Corporation, Jul. 8, 1975.
24. Köhler, E., et al. Converting olefins to diesel—the COD process. *Hydrocarbon Technol. Int.* 1995, Summer, 37-40.
25. Fuhse, J.; Bandermann, F. Conversion of organic oxygen compounds and their mixtures on H-ZSM-5. *Chem. Eng. Technol.* 1987, 10, 323-329.
26. Geleynse, S., et al. The Alcohol-to-Jet Conversion Pathway for Drop-In Biofuels: Techno-Economic Evaluation. Wiley-VCH. 2018 (edition: author manuscript).
27. Gruber P. R., et al. Renewable compositions. U.S. Pat. No. 8,546,627 issued to Gevo Inc., Oct. 1, 2013.
28. ASTM International. ASTM D7566-23b, Standard specification for aviation turbine fuel containing synthesized hydrocarbons; ASTM International: West Conshohocken, PA, November 2023.

All publications mentioned herein are hereby incorporated by reference in their entireties. While the foregoing invention has been described in some detail for purposes of clarity and understanding, it will be appreciated by one skilled in the art, from a reading of the disclosure, that various changes in form and detail can be made without departing from the true scope of the invention in the appended claims.

The examples and corresponding diagrams used herein are for illustrative purposes only. Different configurations and terminology can be used without departing from the principles expressed herein. For instance, steps, equipment, components, and modules can be added, deleted, modified, or re-arranged without departing from these principles Unless the context clearly requires otherwise, throughout the description and the claims: "comprise," "comprising,"

and the like are to be construed in an inclusive sense, as opposed to an exclusive or exhaustive sense; that is to say, in the sense of "including, but not limited to". "Herein," "above," "below," and words of similar import, when used to describe this specification shall refer to this specification as a whole and not to any particular portions of this specification. "Or" in reference to a list of two or more items, covers all of the following interpretations of the word: any of the items in the list, all of the items in the list, and any combination of the items in the list. The singular forms "a," "an," and "the" also include the meaning of any appropriate plural forms.

Where a component is referred to above, unless otherwise indicated, reference to that component should be interpreted as including as equivalents of that component, any component which performs the function of the described component (i.e., that is functionally equivalent), including components which are not structurally or compositionally equivalent to the disclosed structure or composition which performs the function in the illustrated exemplary implementations of the invention.

Specific examples of compositions, systems, methods and apparatuses have been described herein for purposes of illustration. These are only examples. Many alterations, modifications, additions, omissions and permutations are possible within the practice of this invention. This invention includes variations on described compositions that would be apparent to the skilled addressee, including variations obtained by: replacing features, elements and/or chemical compounds with equivalent features, elements and/or chemical compounds; mixing and matching of features, elements and/or chemical compounds from different examples; combining features, elements and/or chemical compounds from examples as described herein with features, elements and/or chemical compounds of other technology; omitting and/or combining features, elements and/or chemical compounds from described examples.

Although the invention has been described with reference to certain specific embodiments, various modifications thereof will be apparent to those skilled in the art without departing from the spirit and scope of the invention.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

The invention claimed is:

1. A two-stage process for producing fuel, comprising:

(a) during an acid-catalyzed conversion stage:

providing an alcohol-containing feedstock in the presence of alkenes;

performing continuous conversion of alcohols over an acid catalyst, the continuous conversion combining the following two steps:

dehydration of alcohols to produce alkenes, and oligomerization of alkenes to produce higher carbon-number alkenes;

adjusting at least one of the following three factors of the continuous conversion: (i) temperature, (ii) pressure, and (iii) molar ratio of alcohols to alkenes, thereby regulating production of aromatics during the acid-catalyzed conversion stage; and separating conversion products into a first plurality of fractions, which comprise a first kerosene fraction, wherein the aromatic content of the first kerosene fraction is within a pre-determined range, and (b) during a hydrotreatment stage:

providing a hydrogen gas feed and a conversion-product feed, wherein the conversion-product feed is a portion of the conversion products and comprises the first kerosene fraction;

performing hydrogenation of the conversion-product feed;

separating hydrotreatment products into a second plurality of fractions, which comprise a second kerosene fraction, wherein the aromatic content of the second kerosene fraction is within the pre-determined range.

2. The process of claim 1, wherein the pre-determined range of the aromatic content of the first and second kerosene fractions is 26.5 vol %.

3. The process of claim 2, wherein the fuel is jet fuel.

4. The process of claim 3, wherein the jet fuel is fully formulated and does not require blending with other materials.

5. The process of claim 4, comprising providing a first recycle stream and a second recycle stream to the continuous conversion to adjust the molar ratio of alcohols to alkenes, thereby regulating the production of aromatics during the continuous conversion, wherein:

(a) the first recycle stream comprises one or more gaseous alkenes that are produced from the continuous conversion;

(b) the second recycle stream comprises one or more liquid alkenes that are produced from the continuous conversion and lighter than the kerosene fraction;

(c) the continuous conversion includes a hydrogen-transfer reaction with alcohols as hydrogen donor and alkenes as hydrogen acceptor to produce carbonyls and alkanes; and (d) the hydrogen-transfer reaction functions as a catalytic pathway to regulate the production of aromatics during the continuous conversion.

6. The process of claim 5, wherein the continuous conversion includes concomitant aldol condensation and dehydration of carbonyls to produce aromatics.

7. The process of claim 1, comprising testing whether the first kerosene fraction contains its aromatic content within the pre-determined range.

8. The process of claim 7, wherein the at least one of the three factors of the continuous conversion is adjusted based on whether the kerosene fraction contains its aromatic content within the pre-determined range.

9. The process of claim 1, comprising providing one or more additional alkenes to the continuous conversion to adjust the molar ratio of alcohols to alkenes.

10. The process of claim 9, wherein the additional alkenes are produced from the continuous conversion but lighter than the kerosene fraction, thereby being recycled to the continuous conversion.

11. The process of claim 10, wherein the acid-catalyzed conversion stage is conducted in an acid-catalyzed conversion unit that comprises first and second catalytic subunits, wherein the additional alkenes produced from the continuous conversion pass through the first catalytic subunit and then the second catalytic subunit, wherein the additional alkenes react to form longer alkenes while passing through the first catalytic subunit, and wherein the continuous conversion is performed in the second catalytic subunit.

12. The process of claim 11, wherein the molar ratio of alcohols to alkenes is adjusted by controlling the reaction of the additional alkenes in the first catalytic subunit.

13. The process of claim 12, further comprising the step of adjusting at least one of the following operating conditions of the first catalytic subunit: temperature, pressure, and flow rate.

14. The process of claim 13, further comprising the step of testing whether the kerosene fraction meets one or more pre-determined property requirements, prior to the adjusting step.

15. The process of claim 9, wherein the additional alkenes are included in a gaseous fraction, in a liquid fraction, or in both, of the first plurality of fractions.

16. The process of claim 1, wherein the continuous conversion includes a hydrogen-transfer reaction with alcohols as hydrogen donor and alkenes as hydrogen acceptor to produce carbonyls and alkanes.

17. The process of claim 16, wherein the continuous conversion includes concomitant aldol condensation and dehydration of carbonyls to produce aromatics.

18. The process of claim 16, wherein the hydrogen-transfer reaction functions as a catalytic pathway to regulate production of aromatics during the continuous conversion.

19. The process of claim 1, wherein one of the three factors of the continuous conversion is adjusted to regulate relative amounts of the second plurality of fractions.

* * * * *